US006099281A

United States Patent [19]

Sobel

[11] Patent Number: 6,099,281

[45] Date of Patent: Aug. 8, 2000

[54] VARIABLE DISPLACEMENT/LOAD DEVICE

[76] Inventor: James Edward Sobel, 837 Beech Hill Rd., Mayfield Village, Ohio 44143

[21] Appl. No.: 09/148,574

[22] Filed: Sep. 4, 1998

[51] Int. Cl.[7] ..... F04C 2/00

[52] U.S. Cl. ..... 418/150; 418/68; 418/268; 418/1; 417/204

[58] Field of Search ..... 418/68, 268, 150, 418/1; 417/204

[56] References Cited

U.S. PATENT DOCUMENTS

| | | | |
|---|---|---|---|
| 2,174,664 | 10/1939 | Konary | 418/150 |
| 4,183,723 | 1/1980 | Hansen et al. | 417/204 |
| 4,410,305 | 10/1983 | Shank et al. | 418/150 |
| 4,486,150 | 12/1984 | Davis | 417/204 |
| 4,746,280 | 5/1988 | Wystemp et al. . | |
| 5,160,252 | 11/1992 | Edwards | 418/1 |
| 5,199,864 | 4/1993 | Stecklein . | |
| 5,431,552 | 7/1995 | Schuller et al. . | |
| 5,558,511 | 9/1996 | Hedelin | 418/150 |

*Primary Examiner*—Thomas Denion
*Assistant Examiner*—Thai-Ba Trieu
*Attorney, Agent, or Firm*—Emerson & Associates; Roger D. Emerson; John M. Skeriotis

[57] ABSTRACT

This design utilizes spherical balls that function as pumping members and also function as bearing loads. The housing includes channels that are used to convert rotary motion to true linear reciprocating motion relative to the center of operation by use of modified involute profile curves. The channels have an enlarged radius of curvature, four (4) contact point designs, and an arch design depending upon application and loads, etc. A variable vane shaft and variable seal plug have a make-before-break design that eliminates damaging high pressure spikes due to the trapped fluid. The vane is used to vary and control pumping arc by directing the high and low pressures. A rotor disclosed has an angle and slots that are designed to align with tangent of the involute curve. The variable displacement disclosed herein is varied by varying the pumping arc thereby causing more or less fluid to be pumped from inlet pressure to inlet pressure which actually affects displacement and input power required. The stroke is always maintained the same and the fluid is not just bypassed or allowed to leak from discharge to inlet, which would not affect input power. The design disclosed herein accomplishes its function with reduced complexity compared to piston pumps, which vary stroke, vane, or other pumps which vary eccentricity by shifting or rotating components.

29 Claims, 24 Drawing Sheets

GTG DESIGN ROTOR CHANNEL OVERLAY PRESSURE AND BALL MOVEMENT DEFINITION

FIG–12 GTG DESIGN ROTOR CHANNEL OVERLAY PRESSURE AND BALL MOVEMENT DEFINITION

FIG-13 GTG DESIGN PRESSURE AND LOAD BALANCING IN REGIONS UNDER GENERAL OPERATION

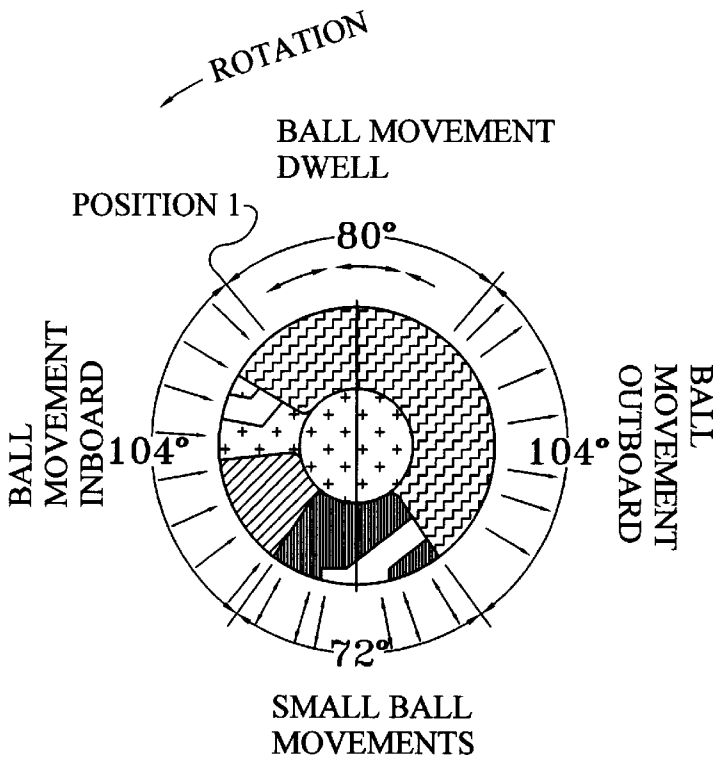
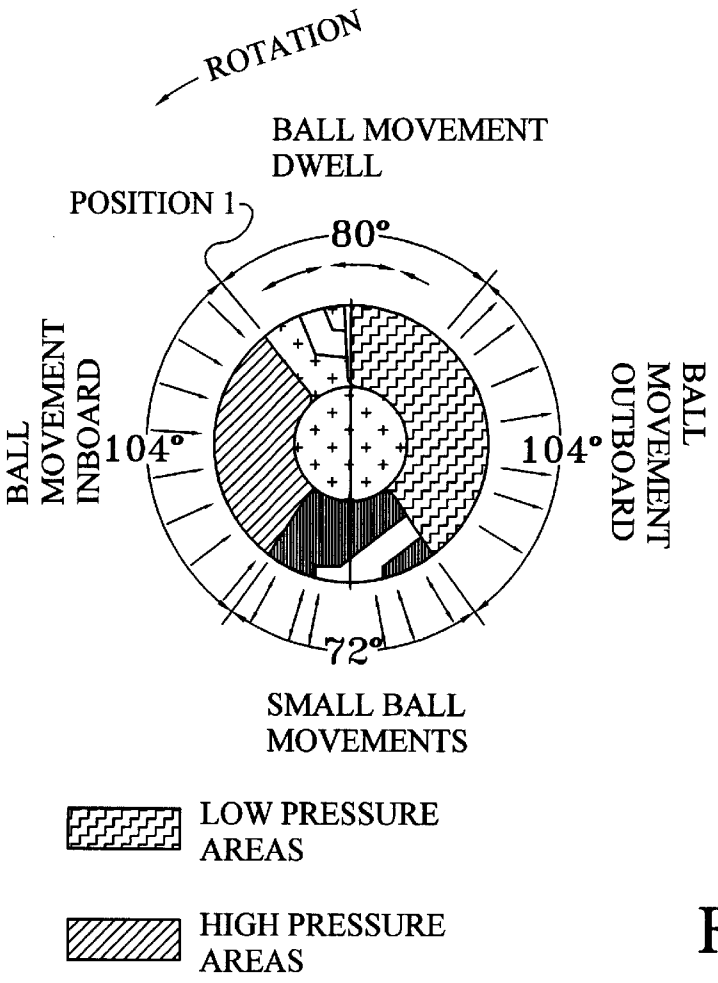
FIG-15 GTG DESIGN VARIABLE DISPLACEMENT OPERATION, VANE SHAFT ROTATED CLOCKWISE

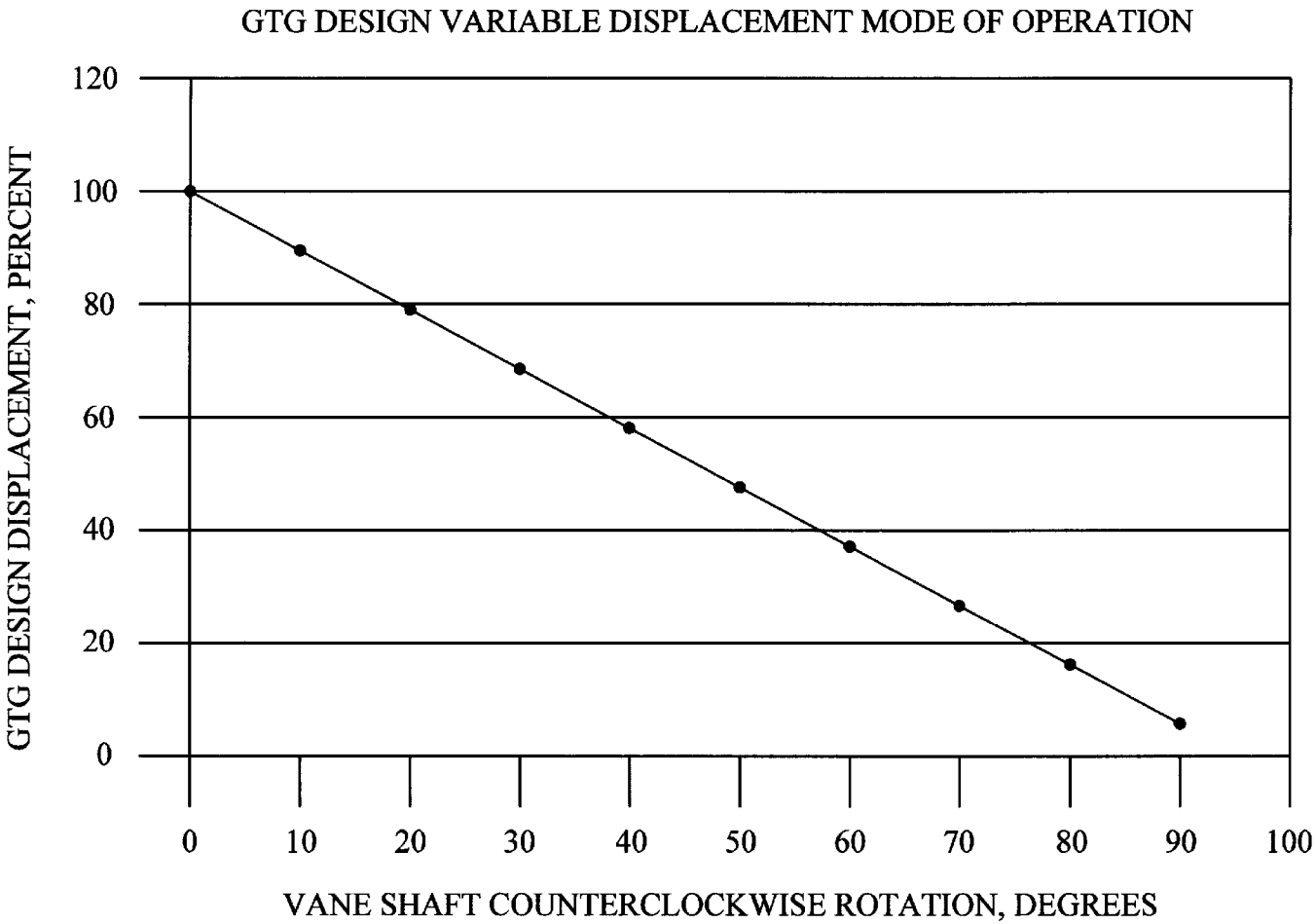
FIG-16 GTG DESIGN TREND IN VARIABLE DISPLACEMENT MODE OF OPERATION. VANE SHAFT ROTATION COUNTERCLOCKWISE

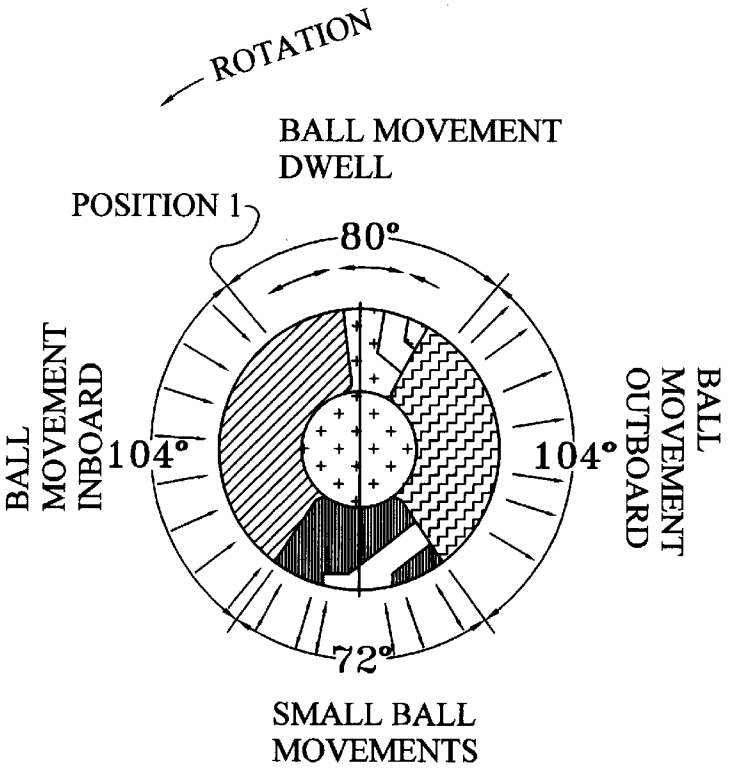
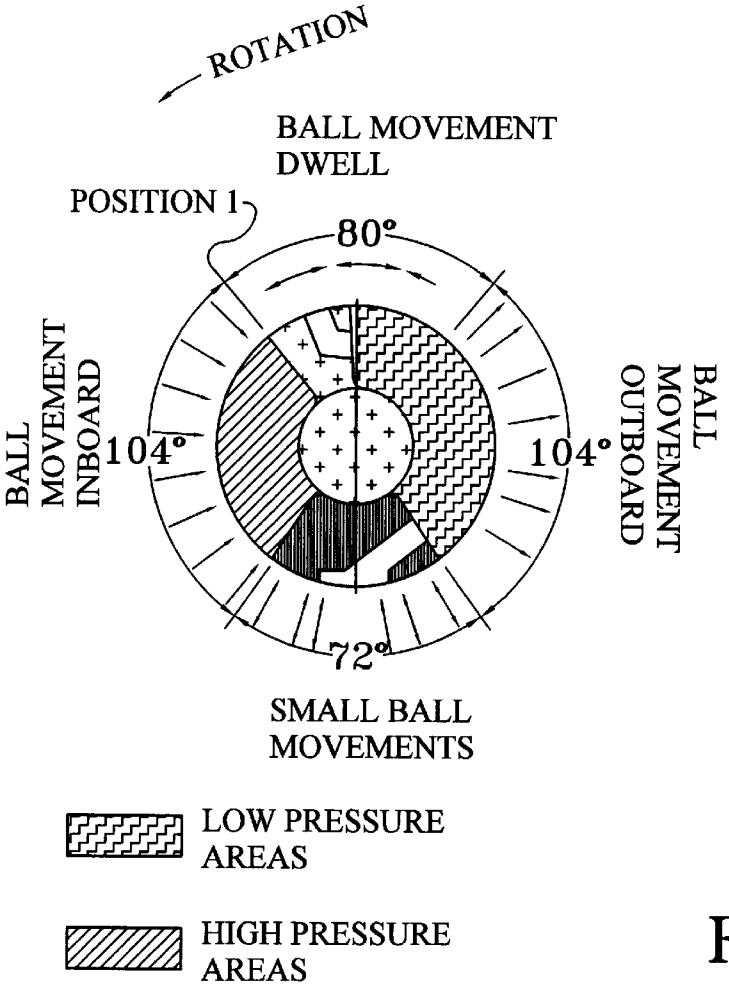
FIG—17 GTG DESIGN CONSTANT DISPLACEMENT VARIABLE ROTATION ASSIST LOADING MODE OF OPERATION. VANE SHAFT ROTATED CLOCKWISE REGION 2 IN ROTATIONAL ASSIST MODE
OF OPERATION
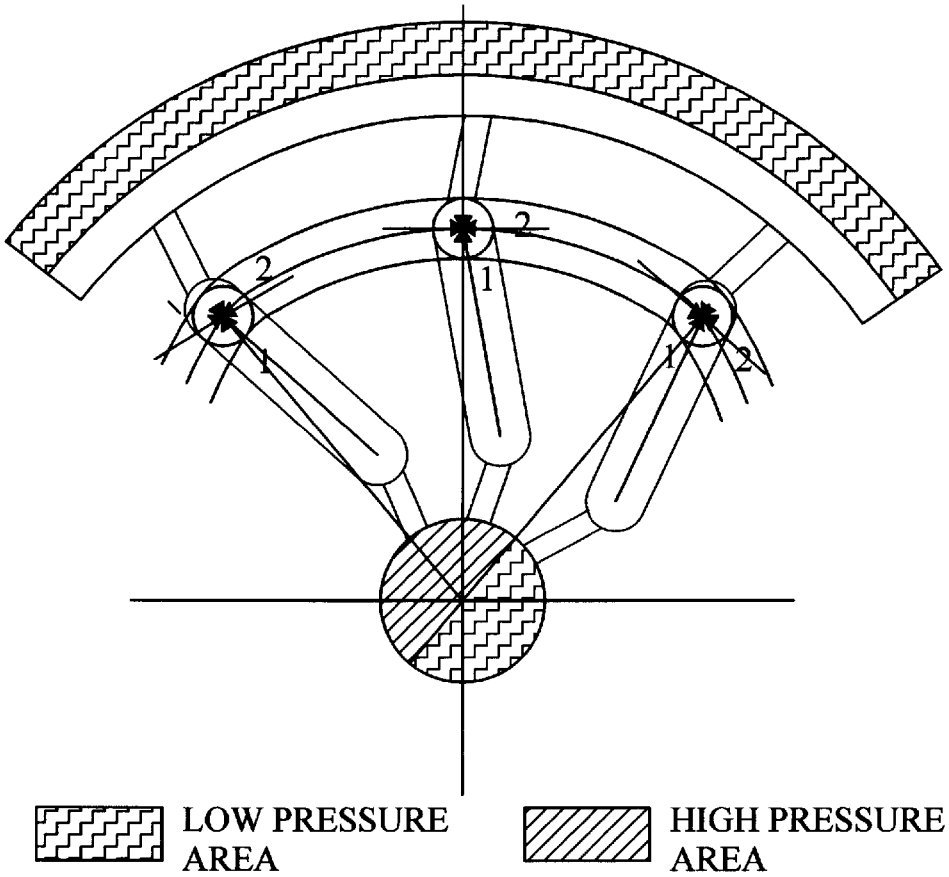
ALL NUMBER 1 FORCES LOAD PERPENDICULAR INTO CHANNEL
ALL NUMBER 2 FORCES ASSIST IN ROTATIONAL LOADING
FIG–18 GTG DESIGN CONSTANT DISPLACEMENT VARIABLE ROTATION ASSIST MODE OF OPERATION

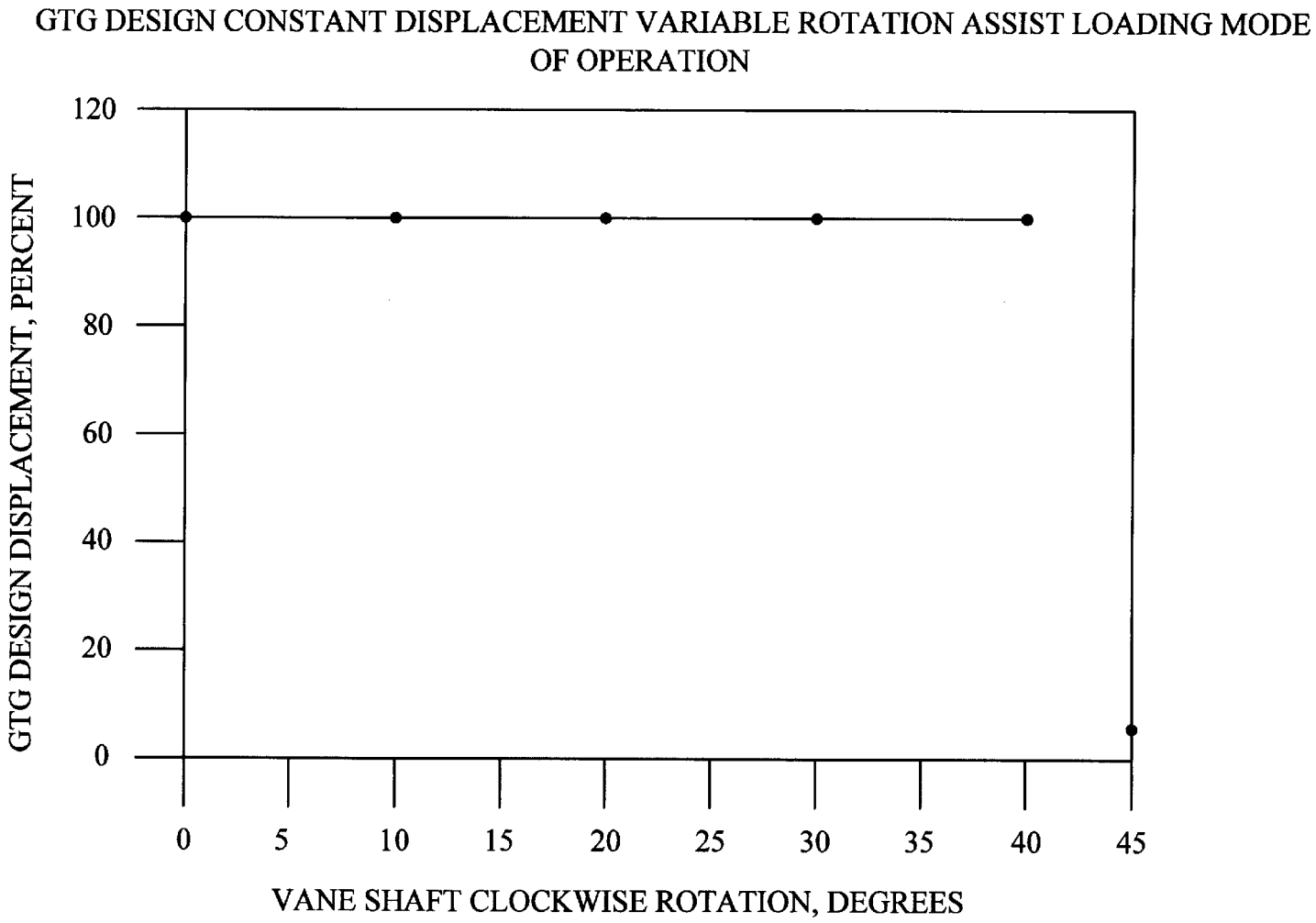
FIG–19 GTG DESIGN TREND IN CONSTANT DISPLACEMENT VARIABLE ROTATION ASSIST LOADING MODE OF OPERATION. VARIABLE VANE SHAFT ROTATION CLOCKWISE

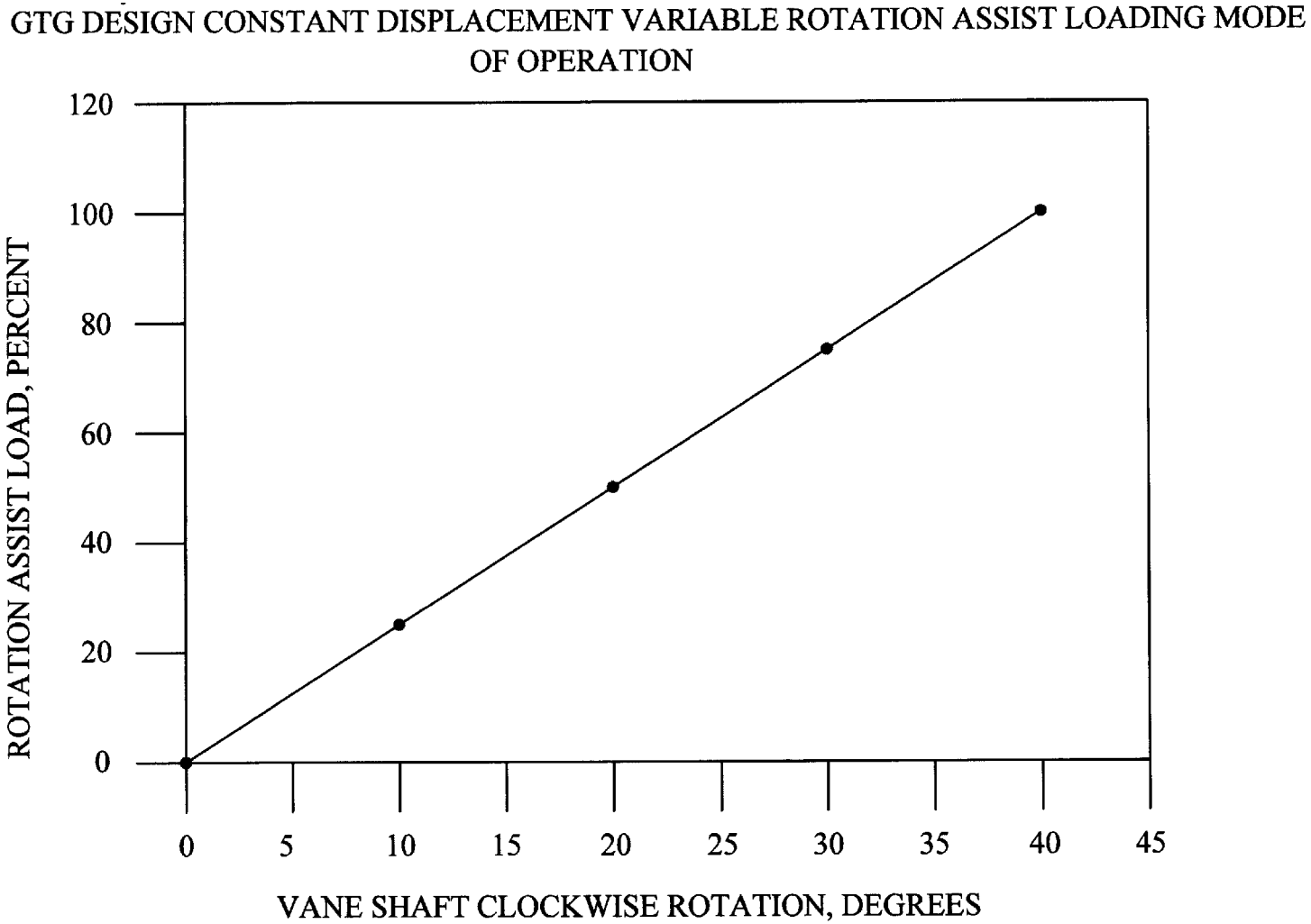
FIG-20 GTG DESIGN TREND IN CONSTANT DISPLACEMENT VARIABLE ROTATION ASSIST LOADING MODE OF OPERATION. VARIABLE VANE SHAFT ROTATION CLOCKWISE

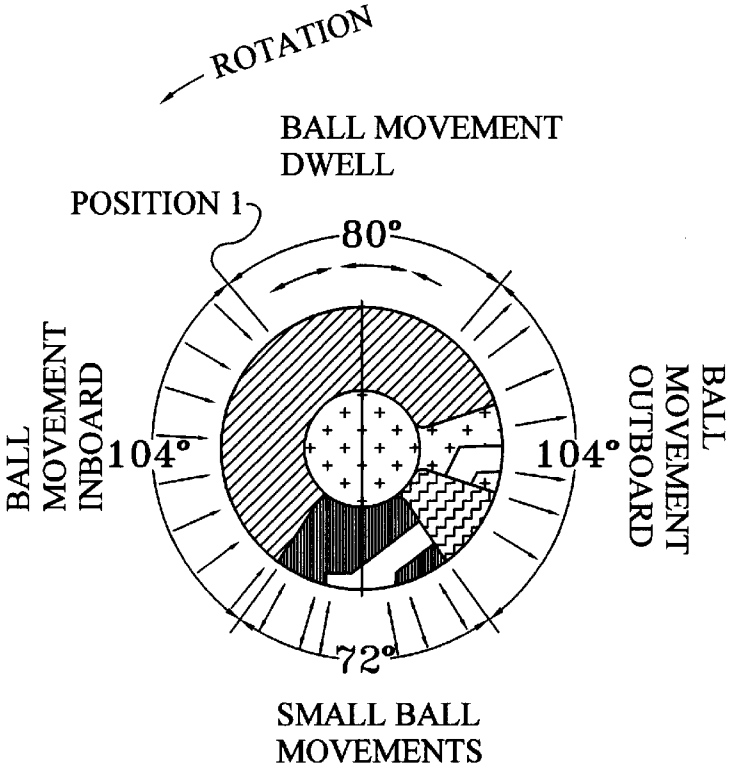
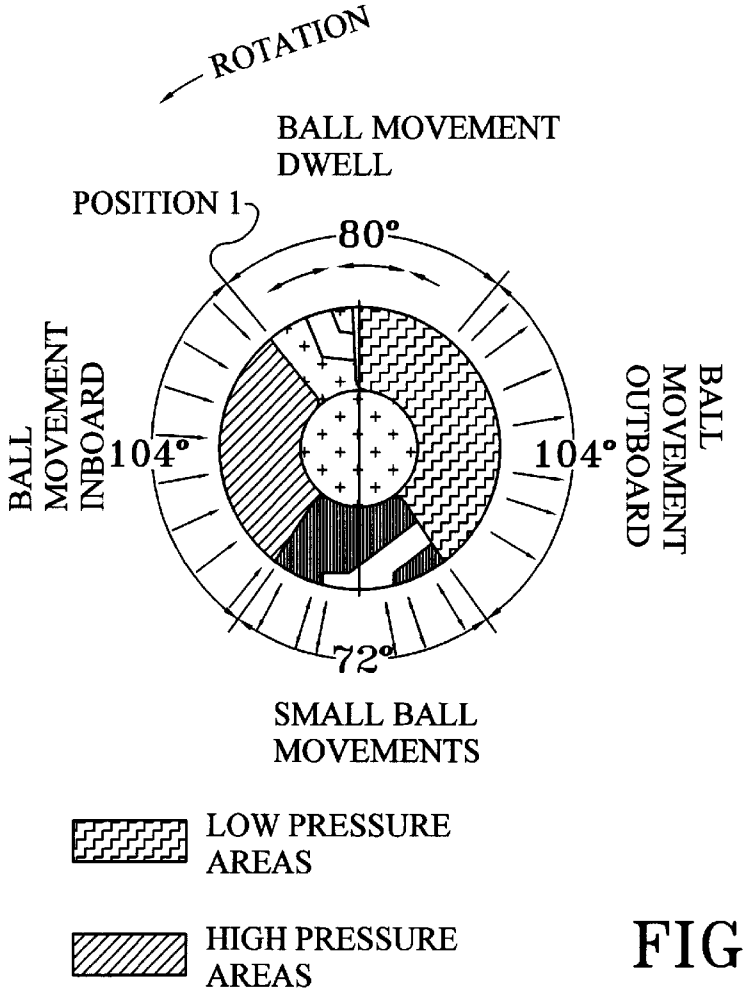
FIG-21
GTG DESIGN VARIABLE DISPLACEMENT VARIABLE ROTATION DRIVE MODE OF OPERATION. VANE SHAFT ROTATED CLOCKWISE

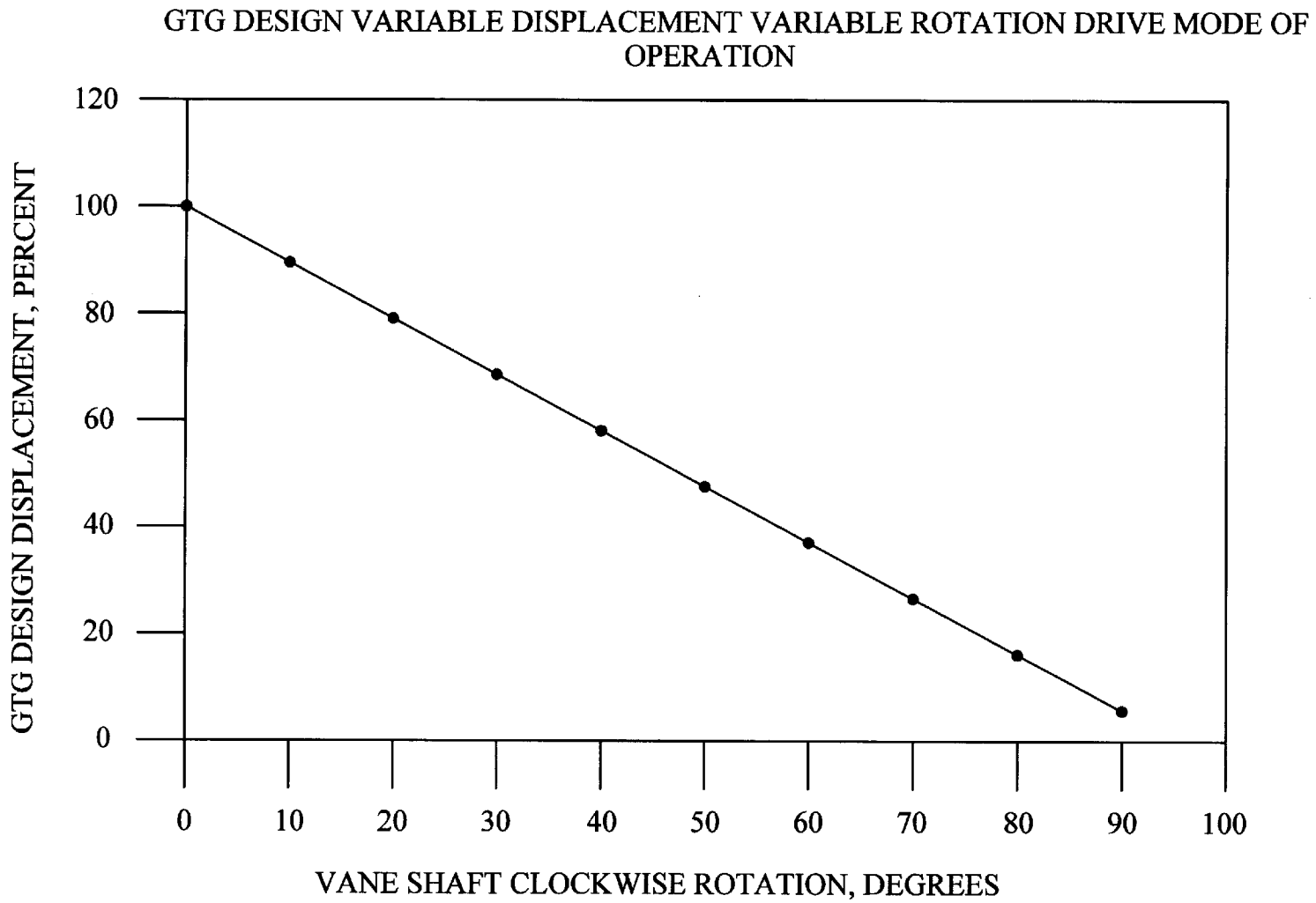
FIG-22 GTG DESIGN TREND IN VARIABLE DISPLACEMENT VARIABLE ROTATION DRIVE MODE OF OPERATION. VARIABLE VANE SHAFT ROTATION CLOCKWISE REGION 1 IN VARIABLE DISPLACEMENT AND VARIABLE ROTATION DRIVE MODE OF OPERATION
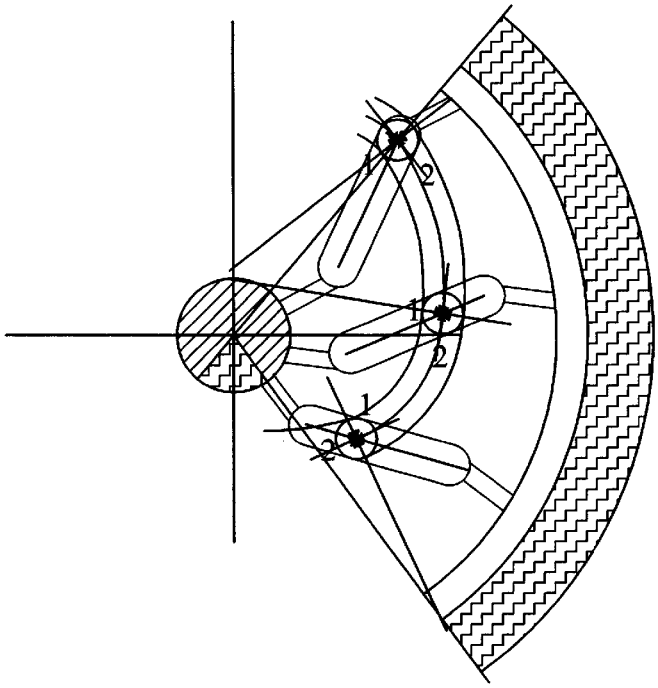
LOW PRESSURE AREA
HIGH PRESSURE AREA
ALL NUMBER 1 FORCES LOAD PERPENDICULAR INTO CHANNEL
ALL NUMBER 2 FORCES PRODUCE ROTATIONAL DRIVE LOADING
FIG-23 GTG DESIGN VARIABLE DISPLACEMENT AND VARIABLE ROTATIONAL MODE OF OPERATION

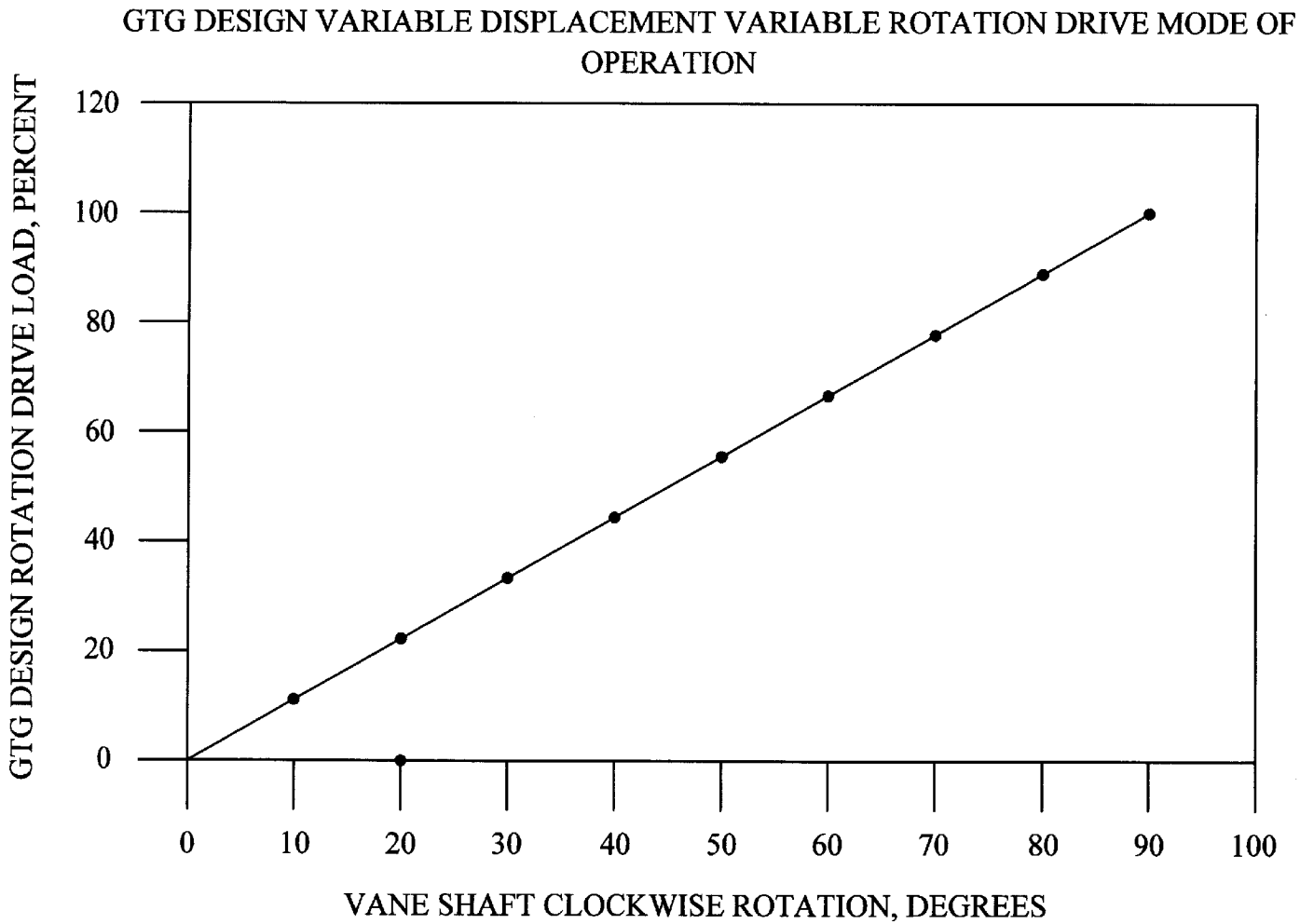
FIG-24 GTG DESIGN TREND IN VARIABLE DISPLACEMENT VARIABLE ROTATION DRIVE MODE OF OPERATION. VARIABLE VANE SHAFT ROTATION CLOCKWISE

VARIABLE DISPLACEMENT/LOAD DEVICE

BACKGROUND OF THE INVENTION

I. Field of the Invention

This invention pertains to the field of pumping devices, power units, and/or drive units and, more particularly, to a variable displacement/load device incorporating spherical balls.

II. Description of the Related Art

The present invention contemplates a new and improved variable displacement/load device, which is simple in design, effective in use, and overcomes the foregoing difficulties and others while providing better and more advantageous overall results.

A sliding vane pump is disclosed with U.S. Pat. No. 4,746,280. The sliding vane pump disclosed within this patent comprises a housing having an inlet and an outlet therein, a liner with a cam-shaped inner surface that is eccentrically disposed within the housing, a rotor that has a plurality of radially disposed slots, a pair of parallel ends, a flat side plate and a plurality of vanes that slide in the slots of a rotor. The rotor is concentric with the housing and rotates about the longitudinal axis. The fluid enters the inlet where it is between the rotor and the liner and then moves around the interior of the liner until the fluid is passed through the outlet. The vanes are strategically biased radially outward typically by springs or hydraulic pressure.

With respect to positive displacement pumps, such as sliding vane positive displacement pumps, the vanes must be maintained in contact with the inner surface of a liner in which the vane moves the vanes move to transport the liquids throughout the pump. Vane pumps are particularly useful in pumping fluids at high temperature.

With respect to rotary pumps, these typically consist a plurality of rotation parts that rotate such that they displace fluids from an inlet to the outlet. Another type of rotary pump is that known as a gear pump that has two or more gears that carry fluid between them and force them out upon meshing with each other.

SUMMARY OF THE INVENTION

In accordance with the present invention, a new and improved variable displacement/load device is provided which overcomes the disadvantages of the prior art as well as providing a new and more efficient variable displacement/load device.

This design utilizes spherical balls that function as pumping members, and serve to provide sealing which is improved due to high precision accuracy and tolerance of standardized available balls. The spherical balls also function as bearing loads. Further, they provide rolling friction verses sliding friction which leads to superior mechanical efficiencies to improve life and wear resistance. Rolling action tends to be self-cleaning thus improving resistance to contaminants. Due to the reduced friction, heat generation is minimized. The spherical balls have a high speed capability that is increased due to the reduced complexity of pumping members and mass associated with the reciprocating motion of this design. Additionally, the spherical balls, with respect to friction, have a low breakaway starting torque. This reduces break-in running at initial assembly due to their high precision tolerance because there are no "high" spots to wear off or seat. Since spherical balls have been standardized more than any other machined element they are manufactured at a low cost.

The housing channels are used to convert rotary motion to true linear reciprocating motion relative to the center of operation by use of modified involute profile curves. The channels have an enlarged radius of curvature, four (4) contact point designs, and an arch design depending upon application and loads, etc.

The ball seals disclosed herein may or may not be needed on some applications depending upon fluid, temperatures, pressure, and volumetric requirements, etc.

The variable vane shaft and variable seal plug have a make-before-break design that eliminates damaging high pressure spikes due to the trapped fluid. The vane is used to vary and control pumping arc by directing the high and low pressures.

The rotor disclosed herein has an angle and slots that are designed to align with tangent of the involute curve. Therefore, no net rotational forces are developed in one region. Additionally, the rotor slot angle is utilized in other regions to create components from pressures, which create rotation assist loading or drive loading. The rotor slots are mirrored which causes axially balancing the rotor from pressure forces developed.

The variable displacement disclosed herein is varied by varying the pumping arc thereby causing more or less fluid to be pumped from inlet pressure to inlet pressure which actually affects displacement and input power required. The stroke is always maintained the same and the fluid is not just bypassed or allowed to leak from discharge to inlet, which would not affect input power. The design disclosed herein accomplishes its function with reduced complexity compared to piston pumps, which vary stroke, vane, or other pumps which vary eccentricity by shifting or rotating components.

The constant displacement variable rotation assist loading is such that displacement is maintained at a constant whereas high pressure is directed to act upon the balls in a region where the rotor slot angle relative to the housing channel causes the applied pressure forces to be broken into components, which are in the direction of rotation. Thus, as more high pressure is directed to act upon the balls the rotational assist load thereby increases.

Within the variable displacement and variable rotation drive mode, displacement is varied by varying the pumping arc thereby limiting the inlet portion of the pump by supplying high-pressure fluids for part of the filling portion of rotation. This high-pressure fluid is directed to act upon the balls in a region where the rotor slot angle relative to the housing channel causes the applied pressure forces to be broken into components, which are in the direction of rotation. As more high pressure is directed for a greater portion of the filling arc, displacement continues to decrease and rotation drive loading increases. Finally, displacement is a minimum (only internal leakage) the rotational drive loading is at a maximum.

This design can be used with hydrostatic drives, transmissions, and other systems. The various types of pumps and motors, such as constant displacement and/or variable displacement, are combined to achieve different system requirements.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts. A preferred embodiment of these parts will be described in detail in the specification and illustrated in the accompanying drawings, which form a part of this disclosure and wherein:

FIG. 15 shows the variable displacement operation where the vane shaft is rotated counterclockwise;

FIG. 16 shows the trend in variable displacement mode of operation where the variable vane shaft is rotated counterclockwise;

FIG. 17 shows the constant displacement variable rotation assist loading mode of operation where the vane shaft is rotated clockwise;

FIG. 18 shows the constant displacement variable rotation assist mode of operation;

FIG. 19 shows the constant displacement variable rotation assist load loading mode of operation where the variable vane shaft is rotated clockwise;

FIG. 20 shows the trend in constant displacement variable rotation assist loading mode of operation where the variable vane shaft is rotated clockwise;

FIG. 21 shows the variable rotation drive mode of operation where the vane shaft is rotated clockwise;

FIG. 22 shows the trend in variable displacement variable rotation drive mode of operation with the variable vane shaft rotated clockwise;

FIG. 23 shows the variable displacement and variable rotation mode of operation; and, FIG. 24 shows the design trend in variable displacement variable rotation drive mode of operation with the variable vane shaft rotated clockwise.

DESCRIPTION OF THE PREFERRED EMBODIMENT

The invention herein disclosed is for a pump, motor, or drive that can be a variable displacement and/or variable load device depending on the application, the configuration chosen, and/or position of the variable vane shaft. The design can be tailored to the specific application and/or families of products. This tailoring will consider geometry, sizes, and materials to meet the application requirements such as, envelope, weight, flow, pressure, loads, environment, etc.

Figure 1:
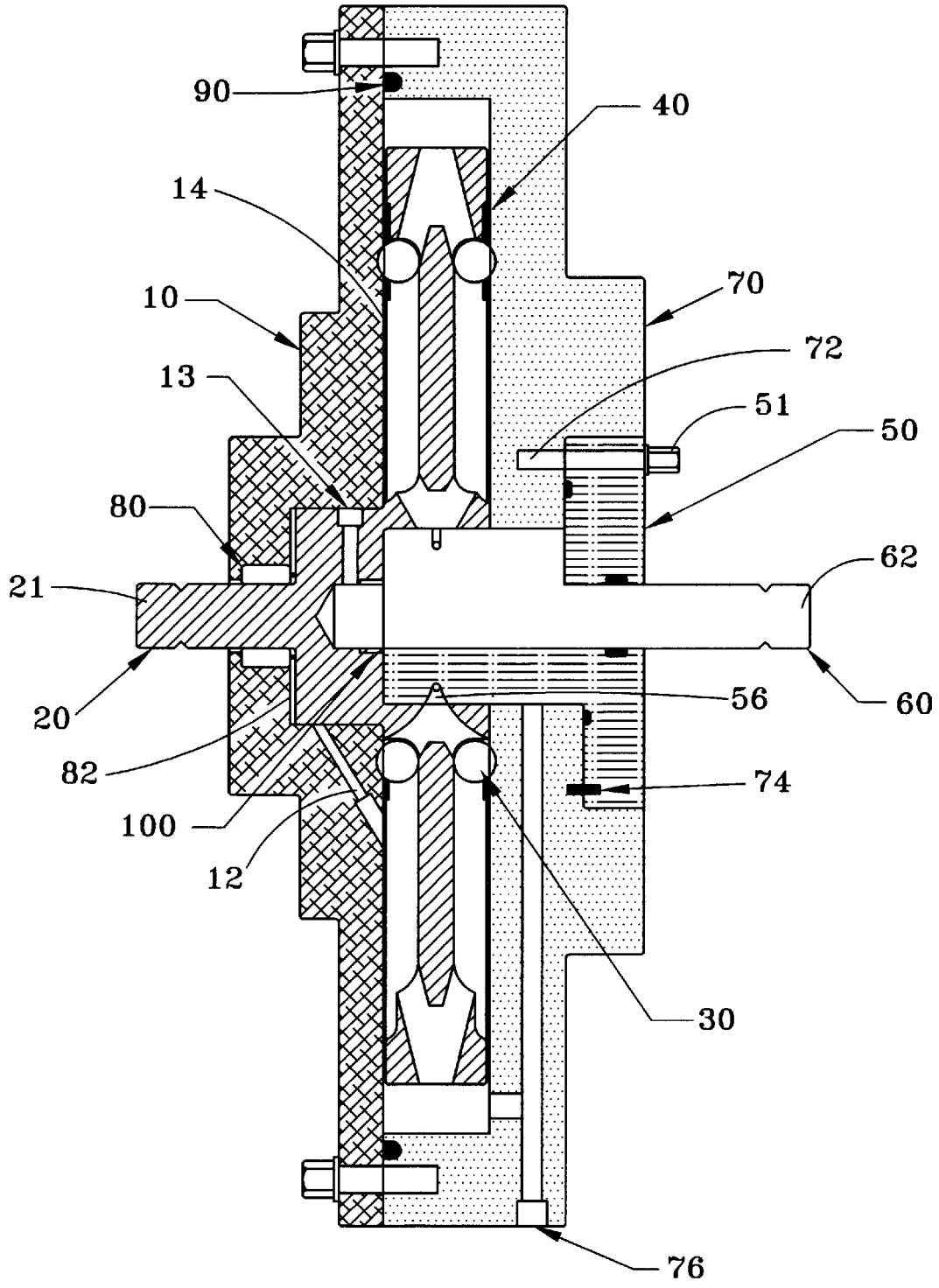
FIG. 1 is a cross-sectional view of the present invention.

FIG. 1 is a cross section showing the variable displacement/load device. Set forth herein are the features and functions of the basic parts that make up this design. As can be seen from FIG. 1, this design contains the following major parts:

Front Cover Housing 10
Rotor 20
Ball 30
Ball Seal 40
Variable Seal Plug 50
Variable Vane Shaft 60
Rear Cover Housing 70
Mechanical Face Seal 80
Miscellaneous Screws, Pins, and Preformed Packings 90

These basic parts and their associated features and functions will be described in detail herein.

The front cover housing 10 provides mounting features, internal geometry for the mechanical face seal 80 including porting to ensure inlet pressure at the seal face, and the modified involute profile with dwells channel 14 described herein. The front cover housing 10 has a port 12 that directs inlet pressure to the front 82 of the mechanical face seal 80 thereby ensuring that the pressure that the mechanical face seal 80 must seal from atmospheric pressure is inlet pressure.

Figure 2:
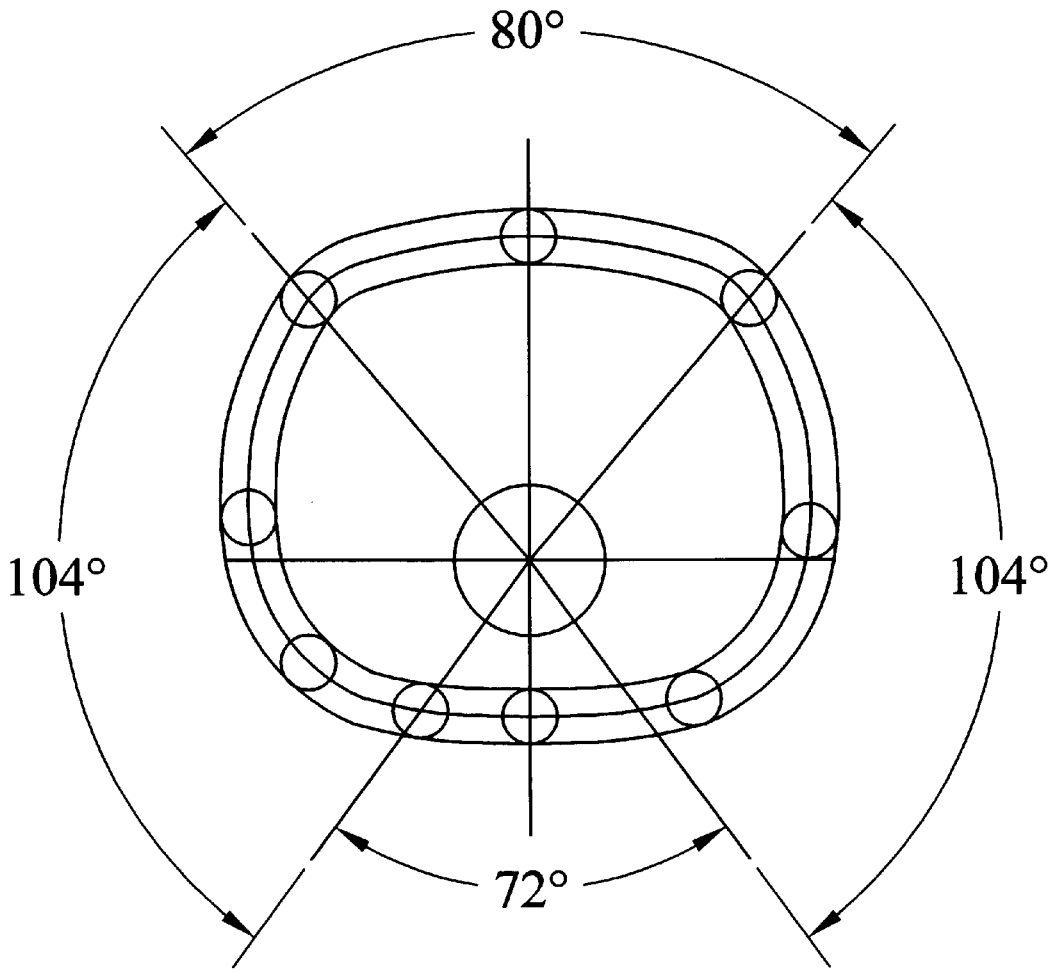
FIG. 2 shows the housing involute profile channel geometry.

The front cover housing 10 contains the modified involute profile with dwells channel 14 geometry. This is a specific design feature of this design and is the foundation controlling ball 30 movement, and dwells, relative to the center of operation. In addition, the channel 14 design is the foundation for pressure load distribution which will be discussed in detail in the operations section. As can be seen from FIG. 2, the modified involute profile channel 14 geometry contains approximately two 104 degree sections of actual involute arcs, approximately an 80 degree section of a radius dwell, and approximately a 72 degree section of a blended radius. Again, these degrees can be adjusted depending upon specific application requirements and are defined herein for the purpose of describing the features of this design.

Figure 3:
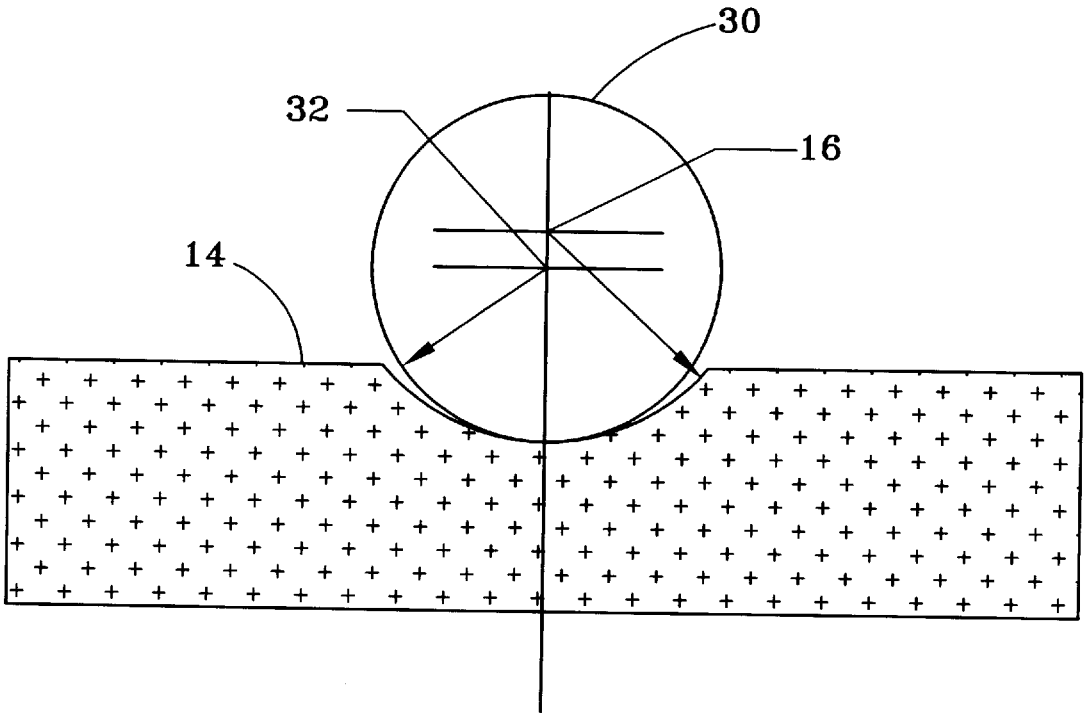
FIG. 3 is a cross-section of the channel geometry.

The actual cross section of the channel 14 geometry is shown in FIG. 3. The cross-section of the channel 14 has many similarities to proven technologies utilized in ball bearing design. In the preferred embodiment, the channel 14 depth is approximately 10% to 70% of the ball diameter and, in the most preferred embodiment, 25% to 30% of the ball 30 diameter, however, this depth may vary depending upon application and other criteria; the radius of curvature 16 of the channel 14 is larger and offset to the actual ball radius of curvature 32.

The features of the channel 14 geometry provide maximum contact area to support pressure loads (thrust and radial) similar to angular contact ball bearings. Additionally, this allows ball 30 movement within the channel 14 maintaining rolling verses sliding ball 30 motion thereby reducing friction wear and minimizing drive torque required.

Further, the channel 14 geometry provides proper guiding of the ball 30 while minimizing drive torque requirements.

Figure 4:
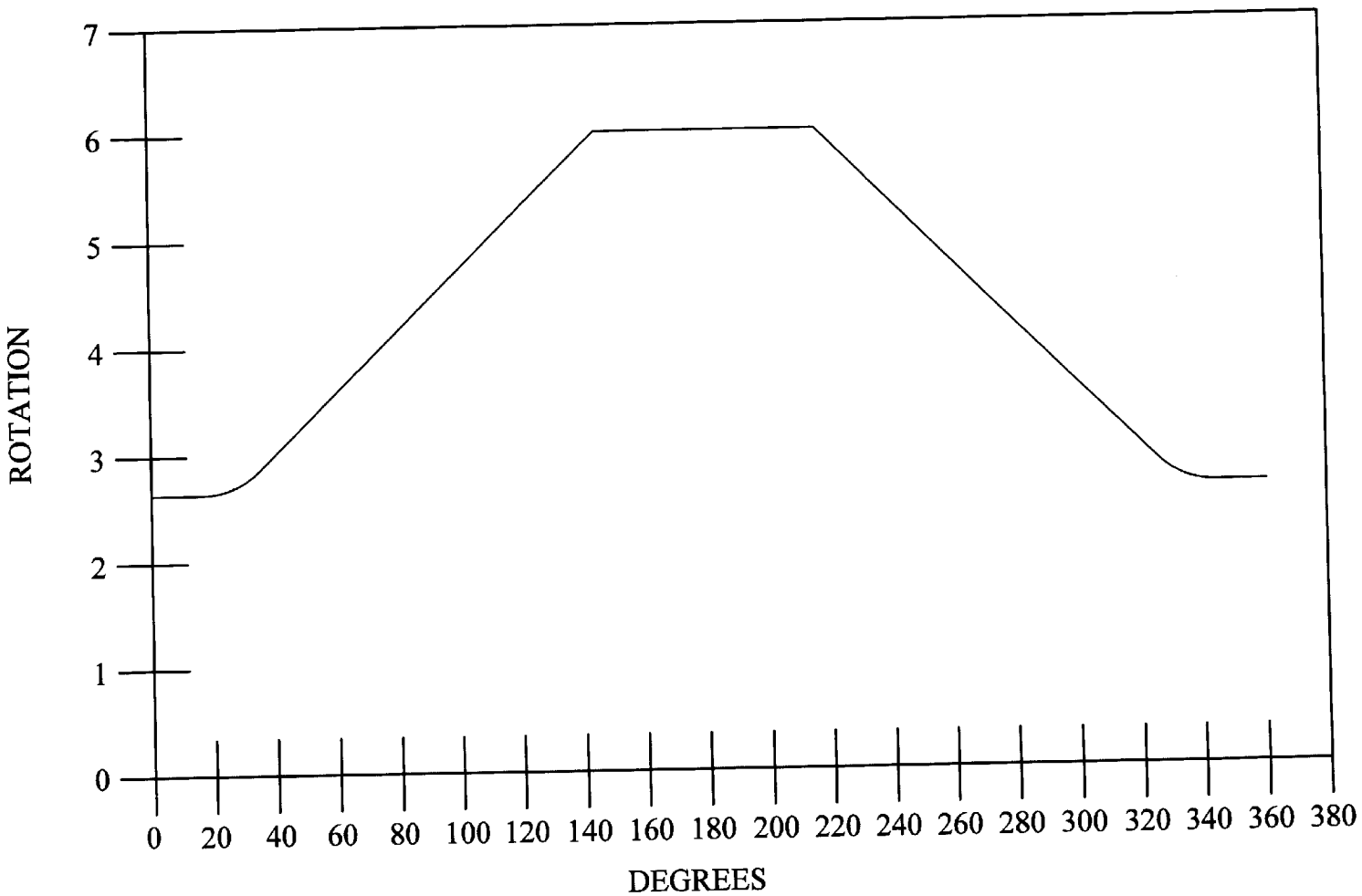
FIG. 4 shows the spherical ball movement/distance relative to the center of operation in graphical form.
Figure 5:
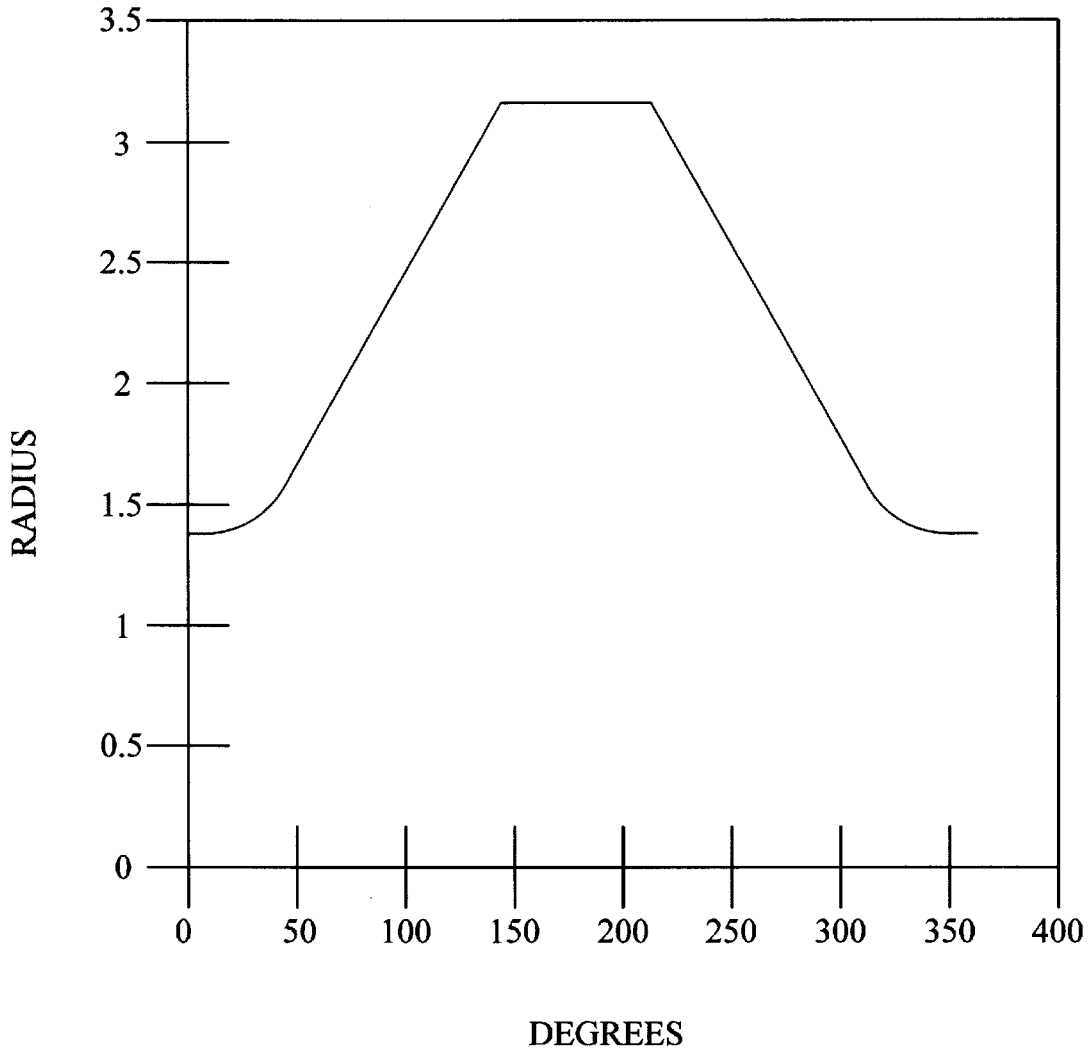
FIG. 5 shows the common method of eccentric diameters.

As this design is rotated, the balls 30 are caused to move and follow the modified involute channel 14. As the balls 30 rotate within the channel 14 their distance relative to the center of operation varies with the modified involute profile with dwells. FIG. 4 shows this ball 30 movement/distance relative to the center of operation. As can be seen in FIG. 4, there are four (4) distinct regions of ball 30 movement/distance:

1). Approximately 104 degrees of actual involute arc where the ball 30 travel is linearly increasing in distance from the center of operation.

2). Approximately 80 degrees of a radius dwell where the ball 30 travel is at a constant distance from the center of operation.

3). Approximately 104 degrees of actual involute arc where the ball 30 travel is linearly decreasing in distance from the center of operation.

4). Approximately 72 degrees of a blended radius where slight ball 30 movement occurs relative to the center of operation. The slight ball motion is the region of the blended radius where the geometry of the ball will experience slight movement where the distance is decreasing with respect to the center of operation and slight movement where distance is increasing with respect to the center of operation.

Figure 6:
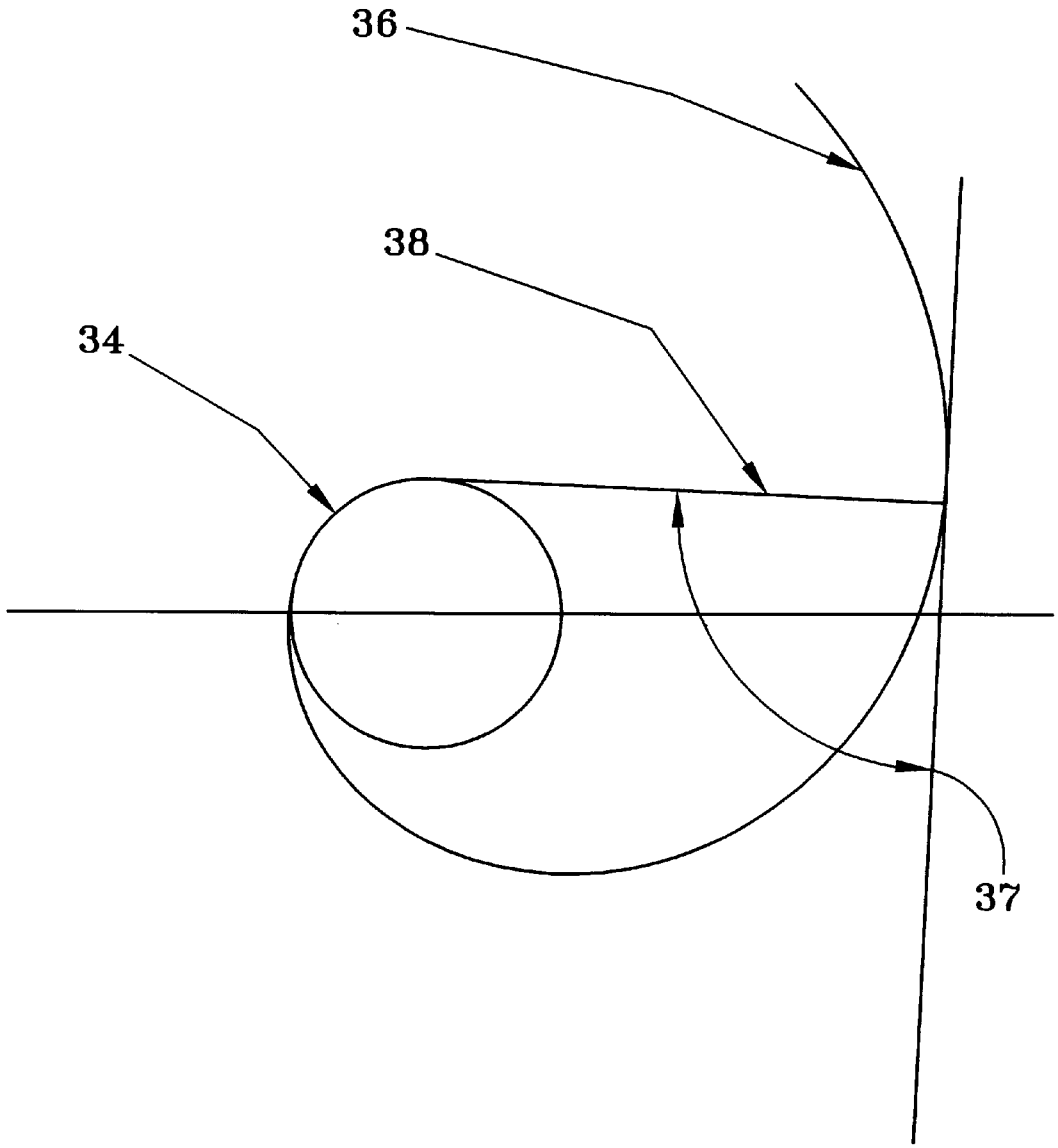
FIG. 6 shows the involute arcs and their properties.

One of the most common ways to cause movement or distance from a center of operation in the pump/motor/drive industry is to have eccentric diameters. FIG. 4 depicts the ball 30 movement/distance that would occur for the method disclosed herein with dwells. As can be seen in FIG. 4, true linear motion relative to the center of operation is achieved and this is a distinct advantage of this design. With reference to FIG. 6, another distinction of this design is the actual involute arcs and their properties. Mathematically, the involute is a continuous, differentiable curve in that it has only one tangent and only one normal at any point on the curve. The curve can be described as the path that is traced by a taut, inextensible cord as it unwinds from the circumference of a fixed base circle 34. The base circle 34 being defined as the circle from which the involute curve is developed and the base circle, in which, for any involute curve there is only one base circle. When the radius of the base circle approaches infinity the involute curve becomes a straight line the base circle will change with respect to application. The base circle being perpendicular to said involute curve. An extremely important facet of the involute curve 36 is that any tangent 38 to the base circle 34 is always normal (perpendicular) to the involute. A line 37 perpendicular from the tangent to the base circle to a point on the involute curve is also shown in FIG. 6. The necessity and advantages of this facet will be further disclosed herein and is noted here as a geometric principle of the involute arc.

The materials for the front cover housing 10 can vary depending upon the application from steels (including proven bearing steel E52100) to nonferrous metals and plastics/composites.

The rotor 20 provides this design with the external drive feature, sealing surface for mechanical face seal 80, bushing 100 including porting to allow cooling flow to support the variable vane shaft 60, rotor slots 22 including geometry for ball seals 40, and porting into and out of rotor slots 22. The external drive feature 21 can be tailored to the specific application, including features that are threaded, keyed, or splined.

A bushing 100 is typically press fit into the rotor 20 to support the variable vane shaft 60. The rotor 20 contains a second port 13 to allow inlet pressure from the rear of the bushing. This second port 13 ensures proper bushing cooling flow.

As the rotor 20 is rotated, the balls 30 follow the modified involute channel 14 in the housings 10, 70. This movement around the channel 14 causes distinct regions of ball 30 movement relative to the rotor center 24. This equates to linear motion for the involute arcs (increasing or decreasing distance), dwell motion, and slight ball 30 motion for the blended radius of the ball 30 in the rotor slots 22 relative to the rotor center 24.

Figure 7:
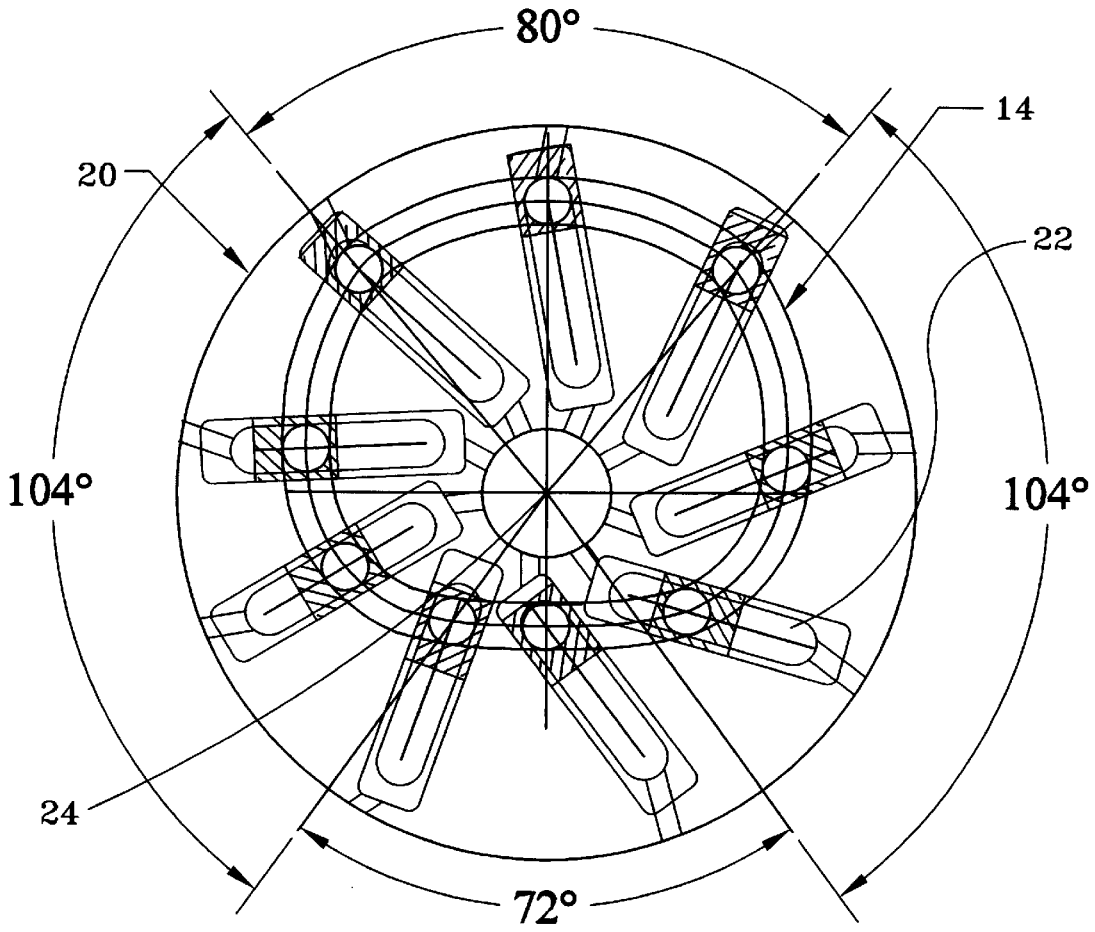
FIG. 7 is an overlay of the rotor and associated channel geometry.

FIG. 7 is an overlay of the rotor 20 and associated channel 14 geometry provided to clarify this ball 30 motion. The positions of the ball 30 in the rotor slots 22 at various locations can be seen relative to the rotor center 24. As the rotor 20 is rotated counterclockwise and the slots 22 rotate around the channel 14 that the ball 30 within the slot 22 will be caused to move towards the outer diameter of the rotor 20, then dwell, move towards the inner diameter of the rotor 20, and have slight movements through the blended radius. Dwell motion being that period of rotation where the ball distance is at a constant distance of operation.

With reference to FIG. 1, the rotor slots 22 are mirrored on both sides of the rotor 20 and, in the preferred embodiment, have common porting both to the inner diameter of the rotor 20 and to the outer diameter of the rotor 20. However, the porting could also be such that each diameter has separate porting. As the ball 30 within the slot 22 moves, this porting allows fluid to enter and exit the rotor slot 22.

Figure 8:
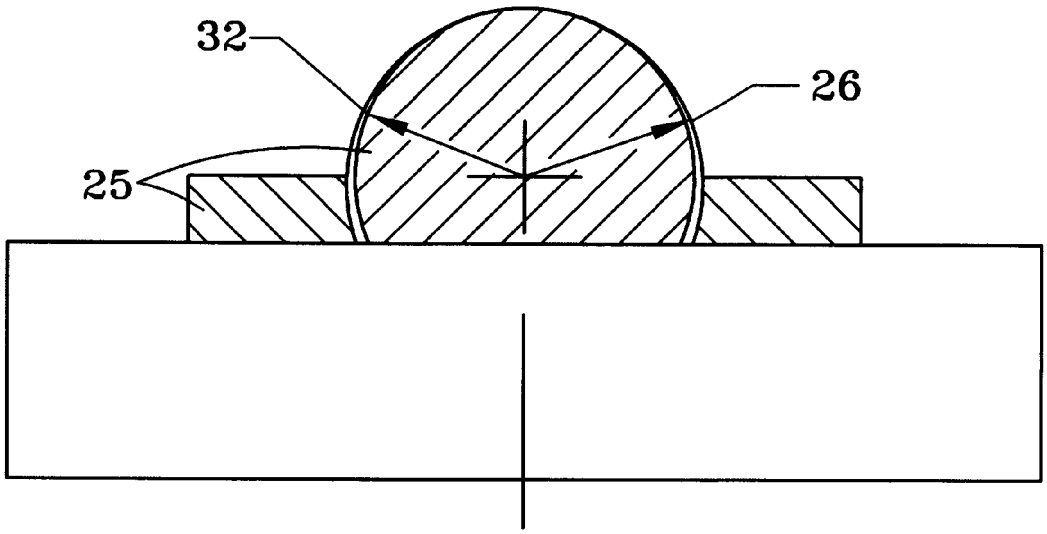
FIG. 8 is a cross-section through the rotor slot.

FIG. 8 is a cross section through the rotor slot 22. The radius of curvature 26 of the slot 22 is slightly larger than the actual ball 30 curvature. This feature provides:

1). Maximum contact area for support of balls 30 rotating loads similar to angular contact ball bearings.

2). Allow ball 30 movement within the rotor slot 22 maintaining rolling verses sliding ball motion, thereby reducing friction wear and minimizing drive torque required.

3). Provide proper guiding of the ball 30 while minimizing drive torque requirements.

It is noted that this radius of curvature 26 is minimized as compared to the housing involute channel 16 curvature mentioned above. This is done because any clearance between the ball 30 and the rotor slot 22 is a direct leak path A around the ball 30 thereby affecting volumetric efficiency.

The shaded area 25 of FIG. 8 is the area of fluid that is displaced as the ball 30 is caused to move within the slot 22. This area is maximized as it directly impacts displacement. As mentioned above, the rotor slots 22 are mirrored on both sides of the rotor 20 thereby maximizing displacement. The pressure balancing advantages of the mirrored slots will be defamed in this document in the operation section. Materials for the rotor 20 can vary depending upon the application from steels (including proven bearing steel E52100) to nonferrous metals and plastics/composites.

The balls 30 provide this design with load support, pumping surfaces, sealing surfaces, rolling verses sliding friction. The balls 30 are based on years of proven ball bearing technology, materials, manufacturability, and applications. Thus, the balls are cost-effective as they are produced through mass production and standardization. Currently, many standard grades, tolerances and materials are available and would be dependent upon the specific application. Some of the standard available materials are AISI E52100 bearing steel, AISI 440 stainless steel, silicone nitride ceramic, tungsten carbide, torlon, and vespel.

Figure 9:
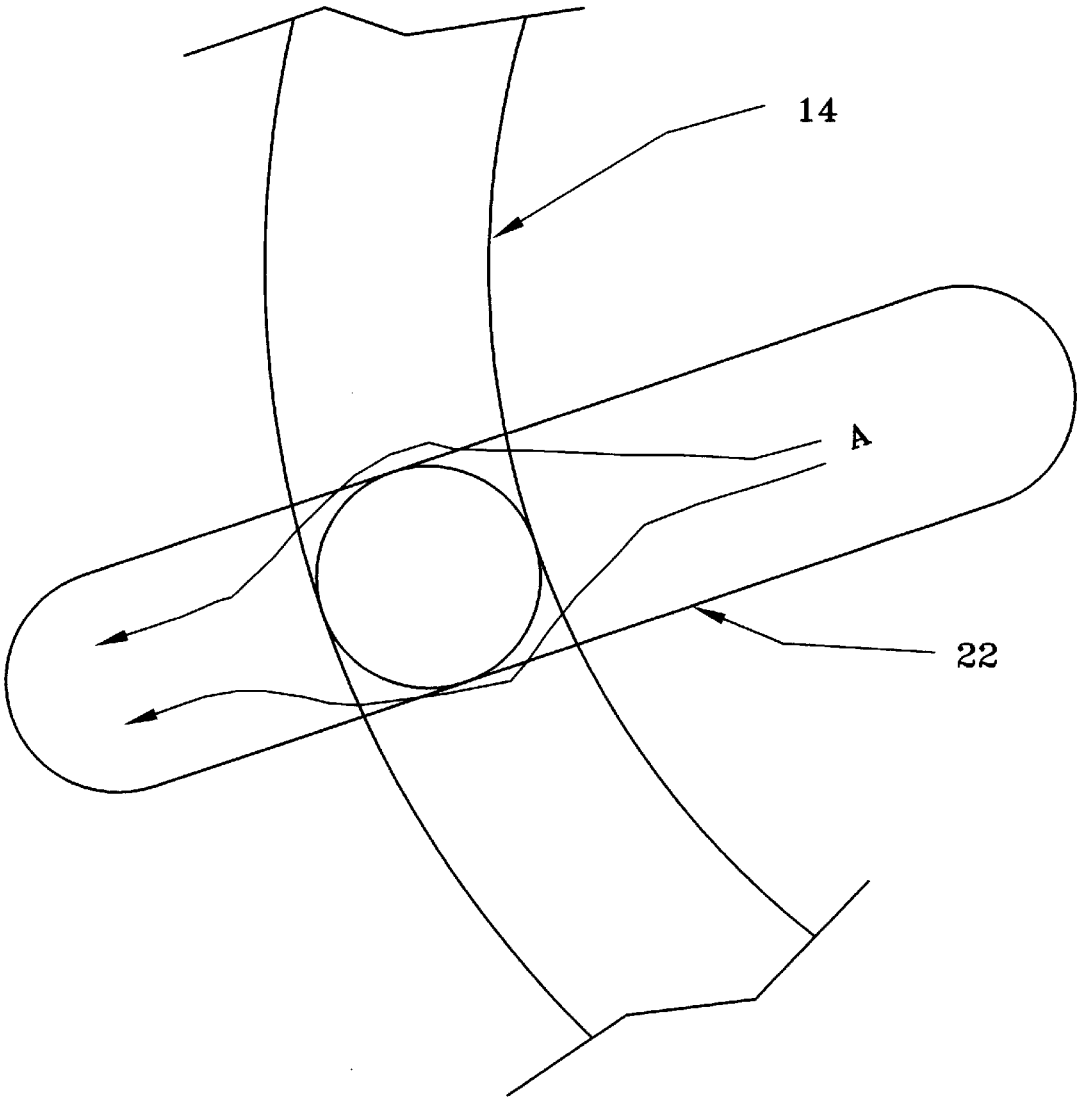
FIG. 9 shows the high pressure to low pressure leakage path around a spherical ball.

The ball seal 40 provides this design with sealing around the ball 30, and provides a larger displaced area. FIG. 9 depicts a leak path A that exits around the ball 30 through the housing involute channel 14 and to the opposite side of the ball 30. This leak path A would affect volumetric efficiency. The ball seal 40 is designed to minimize this leak path A throughout the full rotation of the rotor 20. The ball seal 40 itself is designed to travel with the ball 30 as it moves back and forth within the slot 22. The inner diameter of the ball seal 40 is larger and offset from the actual ball 30 radius thereby minimizing leakage while allowing the ball 30 to have rolling motion. With respect to FIG. 8, the ball seal 40 is contained within a rotor slot 22 rectangular section. Small clearances exist between the ball seal 40 and the rotor slot 22 and this:

1). Allows the ball seal 40 to move freely with the ball 30;

2). Minimizes leakage effects;

3). Minimizes drive torque due to seal contact;

4). Compensates for thermal effects between rotor material and seal material.

Materials for the ball seal 40 vary depending upon application. Common materials would be Toulon (Polyamide-imide), Vespel (Polyimide), and various bronzes.

The variable seal plug 50 provides this design with sealing between high pressure (HP) and low pressure (LP), fluid relief due to small ball 30 movements across the blended radius, support/sealing for the variable vane shaft 60, pinned for radial timing, and slotted attachment to allow alignment to rotor 20 position.

Figure 10:
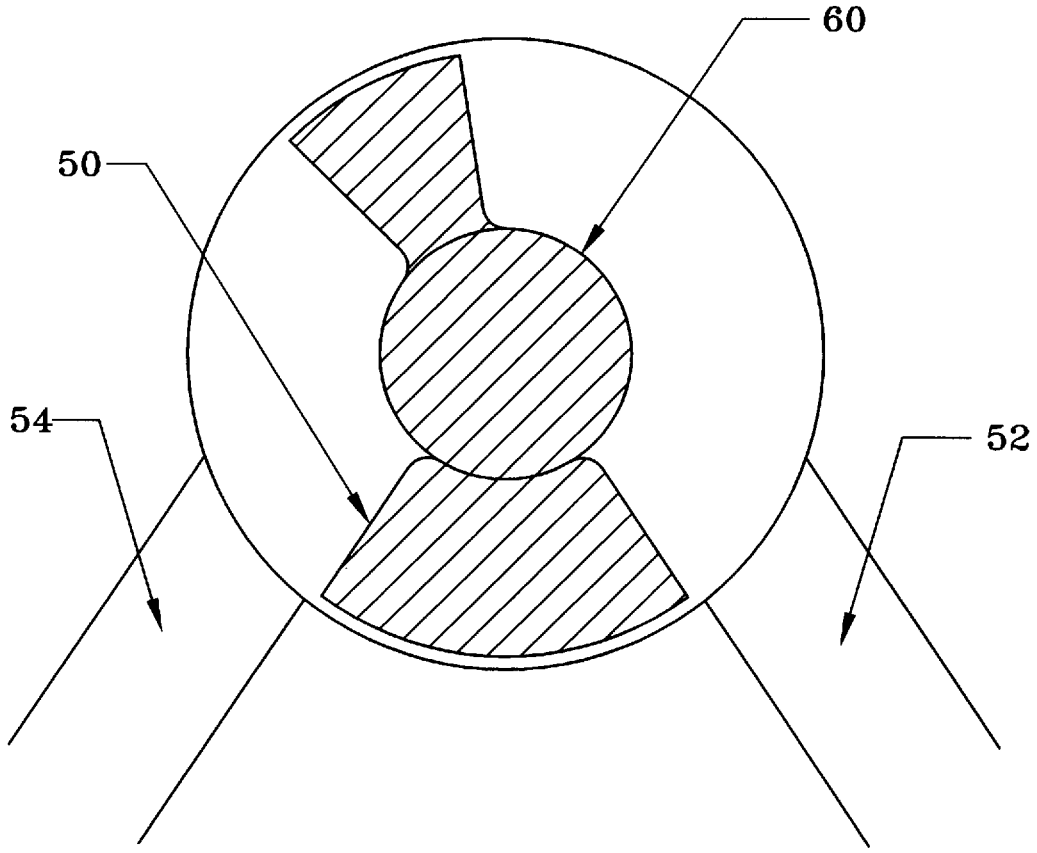
FIG. 10 shows the high pressure and low pressure porting.

FIG. 10 shows the inlet low pressure (LP) port 52 and the outlet high pressure (HP) port 54 and shows the variable seal plug 50 providing sealing by maintaining small clearances. FIG. 1 shows the cross-section of the seal plug 50 and depicts the small clearances both to the inner diameter of the rotor 20 and to the rear cover housing 70 inner diameter. With reference to FIGS. 1 and 10, the sealing/support is provided to the variable vane shaft 60 by the variable seal plug 50.

FIG. 1 shows a cross-hole 56 through the variable seal plug 50. The function of this hole 56 is to provide a path for fluid to move in and out of the rotor slots 22 as they rotate through the blended radius portion of the housing channel 14 where small movements of the ball 30 occur. This hole 56 allows the inner diameter port to the slot 22 to be connected with the inlet low pressure (LP) 52. Extremely large damaging pressure spikes would occur if the fluid were not allowed to freely move in and out of the slot 22 during this the blended radius portion of the rotation. The variable seal plug 50 is pinned for radial timing to ensure this cross-hole 56 feature exits during the blended radius portion of rotation. The variable seal plug also provides a make-before-break connection utilizing the cross-hole similar to the variable vane shaft make-before-break connection.

FIG. 1 shows the mounting of the variable seal plug 50 with screws 51. The variable seal plug 50 is slotted where these screws 51 pass through. This is a feature to allow radial adjustment of the variable seal plug 50 to provide the best alignment with the rotating rotor 20 thus:

1). Eliminating any binding and or adverse wear between the rotating rotor 20 and the stationary variable seal plug 50 or variable vane shaft 60.

2). Minimizing eccentricity thereby minimizing leakage from high pressure to low pressure.

3). Establishing proper alignment for variable vane shaft 60 and support bushing 100 in the rotor 20.

Materials for the variable seal plug 50 vary depending upon application from steels (including proven bearing steel E52100) to torlon, vespel and various bronzes.

The variable vane shaft 60 provides this design sealing between high pressure (HP) and low pressure (LP), a make-before-break connection for rotor porting, variability of displacement and/or load capability, and an external rotating feature to position variable vane shaft 60.

As seen in FIGS. 1 and 10, the variable vane shaft 60 maintains close clearances to the variable seal plug 50, inner diameter of the rotor 20, and inner diameter of the rear cover housing 70, thereby minimizing leakage from high pressure to low pressure.

Figure 11:
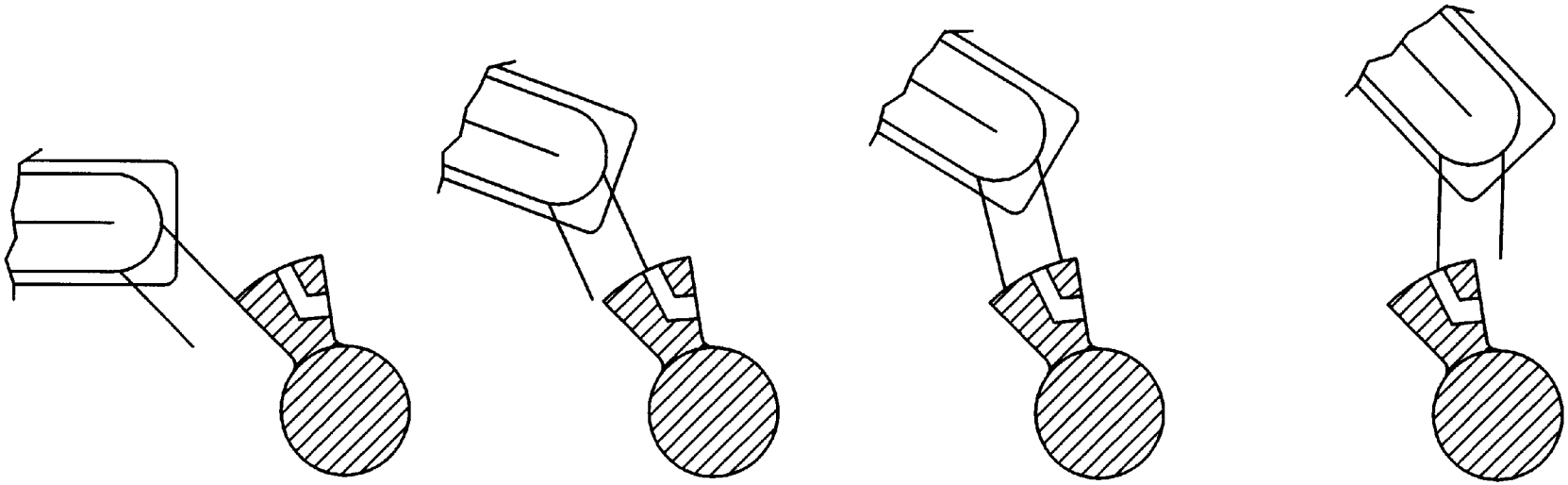
FIG. 11 shows the variable view shaft and rotor slot make-before-brake porting.

As can be seen in FIG. 11, the variable vane shaft 60 is designed to provide a make-before-break connection. This is accomplished by timing the arc length of the vane, sizing/placement of the vane hole, which are all related to the size/placement of the rotor slot 22 inner diameter port passing by the variable vane shaft 60. This ensures that fluid is free to move in and out of the rotor slot 22 as it passes by the variable vane shaft 60. Extremely large damaging pressure spikes would occur if the fluid was not allowed to freely move in and out of the rotor slot 22 as it passed by the variable vane shaft 60.

The variable vane shaft 60 provides a means to vary the displacement and/or load by its position relative to the housing involute channel 14. This will be more fully set forth herein. As can be seen in FIG. 1, the variable vane shaft 60 provides an external drive feature 62 such as a key, thread, spline, etc., in order to vary its position relative to the housing involute channel 14. Materials for the variable vane shaft 60 would vary depending upon application from steels (including proven bearing steel E52100) to torlon, vespel, and various bronzes.

The rear cover housing 70 provides this design with mounting features for the variable seal plug 50/variable vane shaft 60 assembly, unit inlet porting, unit discharge porting, and the modified involute profile with dwells channel 14.

With reference to FIG. 1, the rear cover housing 70 contains the mounting surface with screw holes 72 and an alignment means, such as alignment pins 74, for the variable seal plug 50/variable vane shaft 60 assembly. As mentioned above, the pins 74 provide radial alignment for the variable seal plug 50/variable vane shaft 60 to the blended radius portion of the modified involute profile with dwell channel 14. There are also other methods to provide this alignment and the pins 74 are the preferred method and not meant to limit the invention disclosed herein.

With reference to FIGS. 1 and 10, the rear cover housing 70 provides the unit inlet porting 76. This porting 76 allows the low pressure to be ported to the variable seal plug 50/variable vane shaft 60 area. Additionally, the low pressure is ported within the rear cover housing 70 to the outer diameter of the rotor 20. The rear cover housing 70 provides the unit discharge porting to the variable seal plug 50/variable vane shaft 60 area.

The rear cover housing 70 contains a modified involute profile with dwells channel 14 geometry which is the mirror image and with identical features to the channel 14 contained in the front cover housing 10 mentioned above. Materials for the rear housing cover would vary depending upon the application from steels including proven bearing steel E52100 to nonferrous metals and plastics/composites.

The mechanical face seal 80 provides sealing fluid from externally leaking around the rotating rotor shaft 21. With reference to FIG. 1, the mechanical face seal 80 is mounted in the front cover housing 10 having a carbon face that lightly touches the rotor surface to provide sealing of the operating fluid within the unit as the rotor rotates. The pressure across the seal as mentioned above due to porting in the front cover is maintained at the inlet low pressure to atmospheric. It is noted that other types of seals may be utilized depending upon the specific application.

Miscellaneous screws provide fastening of the unit together and are designed to contain the pressures and loads experienced by the unit. The preformed packings are designed to contain the fluid within the unit and are appropriately designed to the pressures/environment of exposure.

Figure 12:
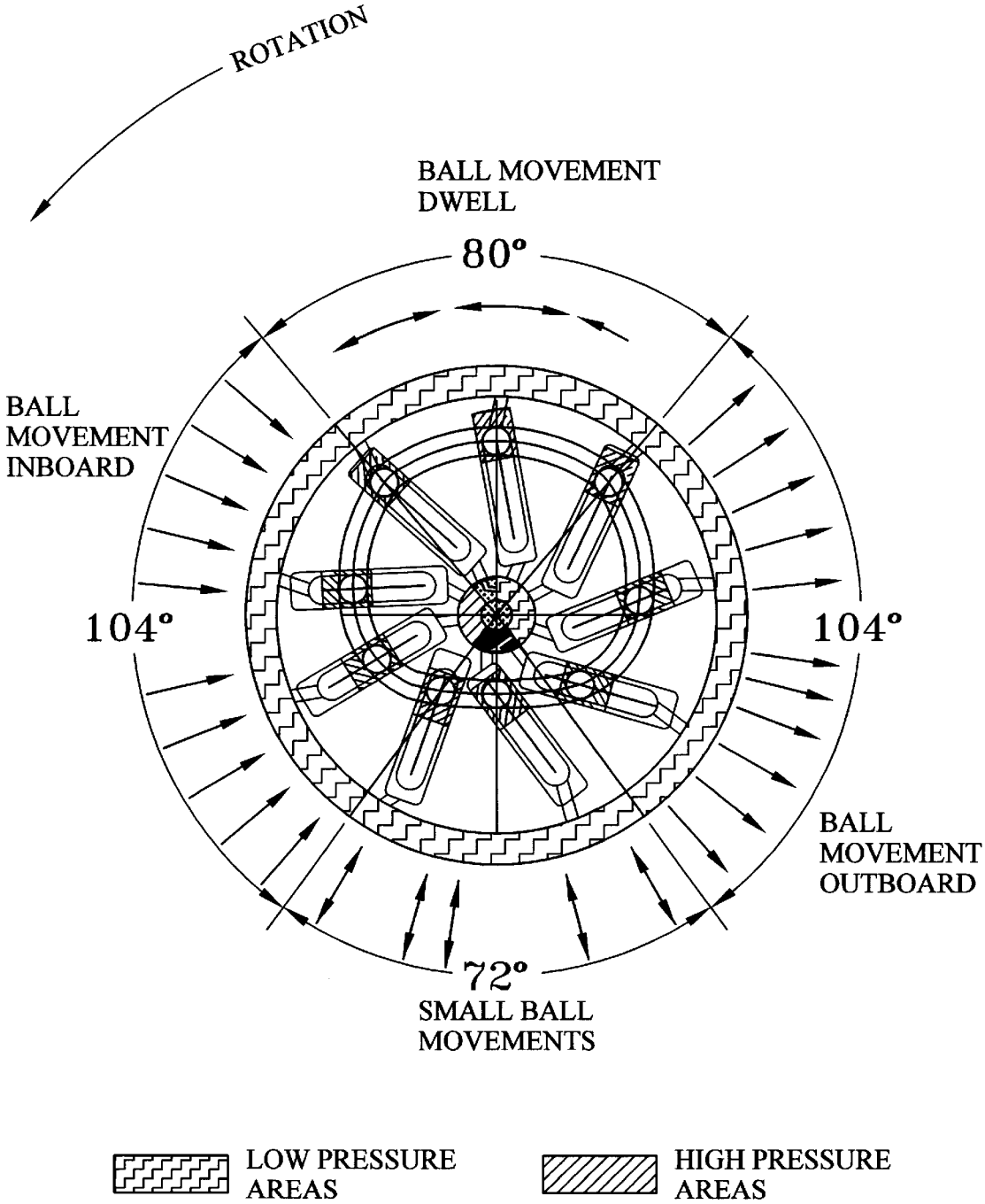
FIG. 12 shows the rotor channel overlay pressure and ball movement.

FIG. 12 is an overlay of major rotor 20 features upon the housing involute channel 14. This overlay will be utilized to define the basic operation as well as establish terminology.

As the rotor 20 is rotated in direction B, the balls 30 are caused to move and follow the housing channel 14. As the balls 30 rotate around the channel 14 their distance relative to the center of operation 92 varies. As previously mentioned above, this creates four (4) distinct regions of operation. The first region is approximately 104 degrees of actual involute arc where the ball 30 travel is linearly moving outboard within the rotor slot 22. The second region is approximately 80 degrees of a radius dwell where ball 30 travel is maintained at a constant distance from the center of operation 92. The third region is approximately 104 degrees of actual involute arc where ball 30 travel is linearly moving inboard within the rotor slot 22. The fourth region is approximately 72 degrees of a blended radius where slight ball 30 movements are occurring.

FIG. 12 defines the regions of low pressure and high pressure. As the ball 30 within the rotor slot 22 move inboard or outboard the rotor slot 22 is filled with fluid on one side of the ball 30, trailing side, and fluid is being discharged on the other side of the ball 30, leading side. The leading side is defined as the direction of ball 30 travel. Therefore, the regions of ball 30 travel described above can now be related to low pressure and high-pressure fluid entering and exiting the rotor slots 22.

In the first region, approximately 104 degrees of actual involute arc where ball 30 travel is moving outboard within the rotor slot 22. As this occurs low pressure fluid is progressively filling the slot from the inner diameter of the rotor. Low-pressure fluid is progressively being discharged to the outer diameter of the rotor 20 (low-pressure area).

In the second region, approximately 80 degrees of radius dwell where ball 30 travel is maintained at a constant distance. During this region of operation low pressure fluid would exist on both sides of the ball 30 within the rotor slot 22.

In the third region, approximately 104 degrees of actual involute arc where ball 30 travel is moving inboard within the rotor slot 22. As this occurs, low pressure is progressively filling the slot from the outer diameter of the rotor 20 and fluid is progressively being discharged into the inner diameter of the rotor 20 (high-pressure area).

In the fourth region, approximately 72 degrees of a blended radius where slight ball 30 movements are occurring. As mentioned above, these slight ball 30 movements would cause extremely large damaging pressure spikes if the fluid were not allowed to freely move in and out of the slot during this region of operation. As previously mentioned above, the cross-hole 56 in the variable seal plug 50 connects the inner diameter port of the slot to a low-pressure area. The outer diameter port of the slot is connected to the low-pressure area at the outer diameter of the rotor 20. Therefore, during this region of operation low pressure fluid would exist on both sides of the ball 30 within the rotor slot 22. Therefore, for every revolution of the rotor 20 each slot 22 would experience a full stroke of the ball 30 outboard and a full stroke of the ball 30 inboard. However, only during third region is fluid actually being discharged to high pressure.

FIG. 1 shows that the rotor slots 22 are mirrored on both sides of the rotor 20. This is done to increase unit displacement. Moreover, from the discussion of low and high pressure above, if the slots 22 are mirrored on both sides of the rotor 20 then axially the rotor 20 will always be pressure balanced throughout all regions of operation. The rotor 20 is radially balanced at its outer diameter as inlet pressure exists all around the circumference of the rotor 20. It is here that the area of high pressure at the inner diameter of the rotor 20 that would cause a load that will be reacted by the ball 30 is in contact with the housing channel 14.

Figure 13:
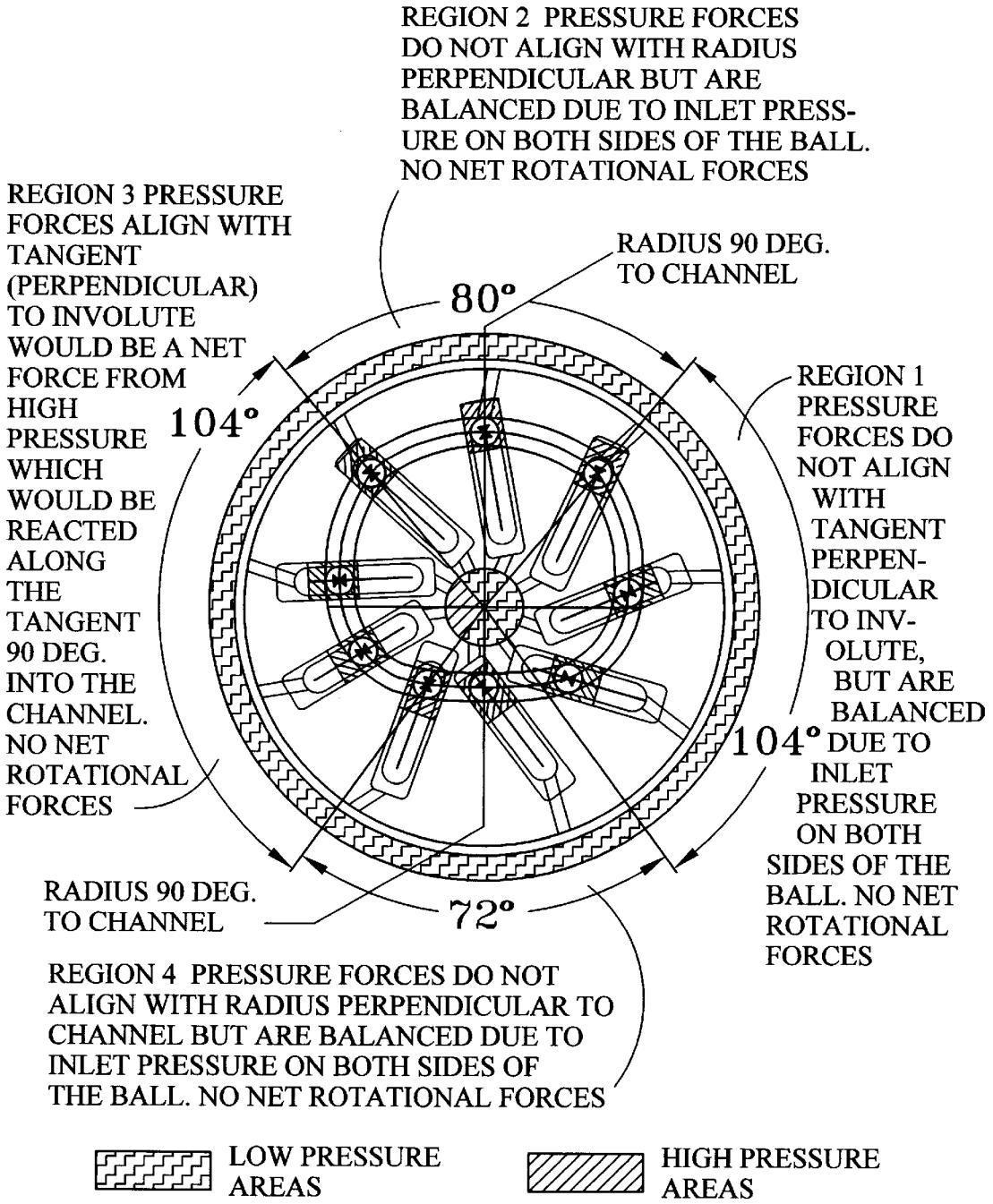
FIG. 13 shows the general pressure and load balancing in regions under general operations.

FIG. 13 is an overlay of the rotor 20 features upon the housing involute channel 14. This overlay will be utilized to define pressure loading effects.

As mentioned above, an extremely important facet of the involute curve is that any tangent to the base circle is always normal (perpendicular) to the involute. FIG. 13 depicts the tangent, which is perpendicular to the channel 14 to the involute curve 36 for each ball 30 shown in the first and third regions as described above. In regions of operation 2 and 4, the radius from the base circle 34 would define the normal (perpendicular) to the channel 14.

FIG. 13 can now be utilized to define pressure loads and effects in each of the regions of operation mentioned above.

Figure 14:
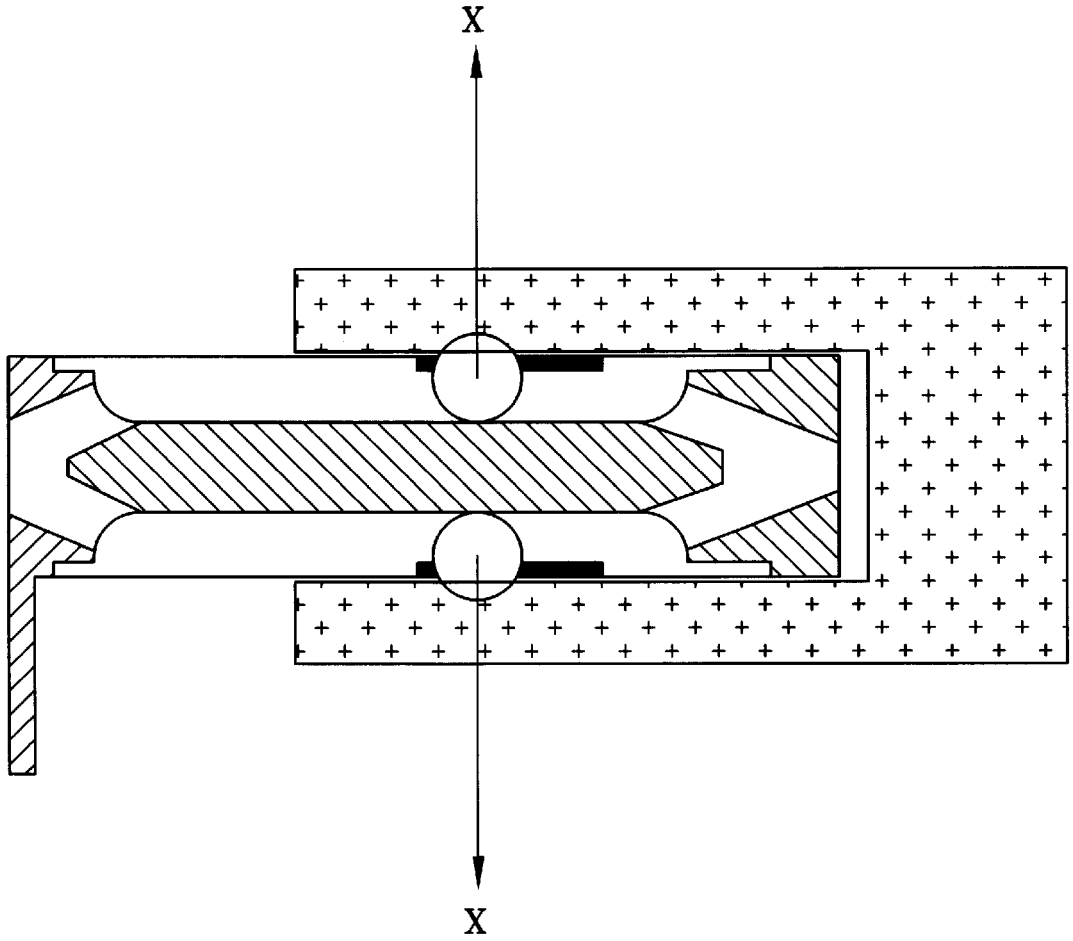
FIG. 14 shows the down force components due to pressure.

Region 1. In this region of operation it can be seen from FIG. 13 that the axis of the rotor slot 22 which defines the pressure load does not align with the tangent (perpendicular) to the channel 14. Therefore, the pressure forces that exist on each side of the ball 30 could be broken into components as shown. Since in this region low pressure is on both sides of the ball 30 the components would be equal and opposite. Therefore, no net force would exist to load the ball 30 into the channel 14 contact area or to cause a rotation moment about the rotor 20. Also, as can be seen in FIG. 14, the down force components would balance being equal and opposite due to the rotor slots 22 being mirrored.

Region 2. In this region of operation it can be seen from FIG. 13 that the axis of the rotor slot 22 which defames the pressure load does not align with the radius (perpendicular) to the channel 14. Therefore, the pressure forces that exist on each side of the ball 30 could be broken down into components as shown. Since in this region low pressure is on both sides of the ball 30 the components would be equal and opposite. Therefore, no net force would exist to load the ball 30 into the channel 14 contact area or to cause a rotation moment about the rotor 20. Also, with reference to FIG. 14 the down force components X would balance being equal and opposite due to the rotor slots 22 being mirrored.

Region 3. In this region of operation it can be seen from FIG. 13 that the axis of the rotor slot 22 which defines the pressure load does align with the tangent (perpendicular) to the channel 14. This is a design feature and the rotor slots 22 are angled based on the tangent to the involute channel 14 in this region. It is shown in FIG. 13 that a net high-pressure load exists in this region. However, that load is purposefully directed to align with the tangent (perpendicular) to the involute channel 14. This load will need to be reacted similar to angular contact ball bearings in the contact area formed between the ball 30 and the housing channel 14. With reference to FIG. 14, the down force components would balance being equal and opposite due to the rotor slots 22 being mirrored.

Region 4. In this region of operation it can be seen from FIG. 13 that the axis of the rotor slot 22 which defines the pressure load does not align with the radius (perpendicular) to the channel 14. Therefore, the pressure forces that exist on each side of the ball 30 could be broken down into components as shown. Since in this region low pressure is on both sides of the ball 30 the components would be equal and opposite. Therefore, no net force would exist to load the ball 30 into the channel 14 contact area or to cause a rotation moment about the rotor 20. With reference to FIG. 14 the down force components would balance being equal and opposite due to the rotor slots 22 being mirrored.

This section will discuss operation of this design in the variable displacement mode. The general operation and pressure load/balancing that was described above provided familiarization with the basic operation and terminology utilized in this design.

FIG. 15 shows a removed cross-section of the variable vane shaft 60 and variable seal plug 50. As discussed above, as the rotor 20 is rotated the ball 30 are caused to move and follow the housing channel 14. As the balls 30 rotate around the channel 14 their distance relative to the center of operation 92 varies. As the ball 30 within the rotor slot 22 move inboard or outboard the rotor slot 22 is being filled with fluid on one side of the ball 30 (trailing side) and fluid is being discharged on the other side of the ball 30 (leading side). By moving (rotating) the variable displacement vane 60 this design can vary and control whether the rotor slot 22 is being filled or discharging into high pressure and/or low pressure fluid.

For example, in FIG. 15 as the variable vane shaft 60 is rotated counterclockwise it can be seen that the area of low pressure (LP) is increased and the area of high pressure (HP) is decreased within the inner diameter of the rotor 20. Therefore, even though the balls 30 would begin to move inboard starting at position 1, the fluid that would be discharged on the leading side of the ball 30 would be directed to the low pressure (LP) area due to the position of the variable vane shaft 60. This ultimately would cause a reduction in displacement because for part of the inboard stroke the ball 30 would just be returning discharging fluid into the low-pressure (LP) area. As the variable vane shaft 60 is further rotated counterclockwise, displacement would continue to decrease proportionately as more of the inboard stroke is directed to the low-pressure (LP) area. The pressure balancing would be maintained as the low-pressure area is increased because low pressure would be on both sides of the ball 30 in the slot 22. The variable displacement disclosed is varied by varying the pumping arc thereby causing more or less fluid to be pumped from inlet pressure to inlet pressure which actually affects displacement and input power required.

FIG. 16 shows how displacement varies as the variable displacement vane shaft 60 is rotated counterclockwise.

In conclusion, by moving the variable vane shaft 60 within the approximately 104 degrees of actual involute arc where the ball 30 is moving inboard in the rotor slot 22, this design can vary displacement from minimum to maximum.

This section will discuss the operation of this design in the constant displacement variable rotation assist mode of operation. This mode of operation is achieved by varying the position of the variable displacement vane shaft 60 within the approximately 80 degrees of radius dwell where ball 30 travel is maintained at a constant distance from the center of operation 92.

FIG. 17 shows a removed cross-section of the variable vane shaft 60 and the variable seal plug 50. As mentioned above, this region is a radius dwell where the ball 30 is maintained at a constant distance from the center of operation 92. Therefore, fluid is neither entering nor exiting the slot 22 and this region has no effect on displacement of this design. FIG. 17 shows that as the variable vane shaft 60 is rotated clockwise the area of high pressure (HP) is increased and the area of low pressure (LP) is decreased within the inner diameter of the rotor 20. This has no effect on displacement but does cause high-pressure (HP) fluid to be on the side of the ball 30 from the inner diameter of the rotor slot 22. The other side of the ball 30 is ported to the outer diameter where low pressure (LP) exists. FIG. 18 shows the pressure loads and the components that would exist due to this high pressure (HP) being ported to the ball 30 from the inner diameter of the rotor slot 22. Here there would be a load component perpendicular to the channel 14 that the channel 14 would need to support. Moreover, there would be a rotational load component in the direction of rotation. This force would assist this design by being in the direction of rotation. As the variable vane shaft 60 is further rotated clockwise within this region, the high pressure (HP) area continues to increase proportionately thereby causing additional rotational load components to exist increasing the rotational assist to this design.

FIG. 19 shows that as the variable vane shaft 60 is rotated in this region displacement of this design remains constant. FIG. 20 shows that as the variable vane shaft 60 is rotated clockwise in this region the rotational assist loading is increased.

In conclusion, by moving the variable vane shaft 60 within the approximately 80 degrees of radius dwell where ball 30 travel is maintained at a constant distance from the center of operation 92 this design can maintain displacement while varying a rotational assist load.

This section will discuss operation of this design in the variable displacement and variable rotation drive mode of operation. This mode of operation is achieved by varying the position of the variable vane shaft 60 within the approximately 104 degrees of actual involute arc where ball 30 travel is moving outboard within the rotor slot 22.

FIG. 21 shows a removed cross-section of the variable vane shaft 60 and the variable seal plug 50. As the variable vane shaft 60 is rotated clockwise the area of high pressure (HP) is increased and the area of low pressure (LP) is decreased within the inner diameter of the rotor 20. As mentioned above, this is the area where the balls 30 are traveling outboard and being filled with fluid from the inner diameter of the rotor 20 (trailing edge) and fluid is being discharged to the outer diameter of the rotor 20 low pressure (LP). Therefore, as the high pressure (HP) area is increased by the rotation of the variable vane shaft 60 a portion of this filling into the slot 22 would be from the high pressure (HP). As the variable vane shaft 60 is further rotated clockwise a larger portion of the filling into the slot 22 would be from high pressure (HP) and not from low pressure (LP). Therefore, as the variable vane shaft 60 is rotated clockwise within this region this design displacement is reduced do to increased filling into the slot 22 by the high pressure (HP) fluid and not the low pressure (LP) fluid.

FIG. 22 shows the trend of how displacement would vary as the variable vane shaft 60 is rotated within this region. Displacement varies from a maximum to a minimum value that would be internal leakage (high to low pressure) of this design.

FIG. 21 shows that as the variable vane shaft 60 is rotated clockwise within this region the area of high pressure in the inner diameter of the rotor 20 is increased and the effects on displacement are as discussed above. This high pressure (HP) is ported to one side of the ball 30 from the inner diameter of the rotor slot 22 whereas the other side of the ball 30 is ported to the outer diameter of the rotor slot 22 where low pressure (LP) exists. FIG. 23 shows the pressure loads and the components that would exist due to this high pressure (HP) being ported to the ball 30 from the inner diameter of the rotor slot 22. There would be a load component perpendicular to the channel 14 that the channel 14 would need to support. Moreover, there would be a rotational load component in the direction of rotation. This force would tend to drive this design by being in the direction of rotation. As the variable vane shaft 60 is rotated clockwise the area of high pressure would increase and the rotational load components would increase. These rotation load components would vary depending upon the angle between the rotor slot 22 (pressure load angle) relative to the perpendicular to the channel 14 (involute tangent to base circle) 34.

FIG. 24 shows the trend of how the variable rotational drive load varies as the variable vane shaft 60 is rotated within this region. To determine actual operation points from a displacement and rotational drive load it is desired to reference FIGS. 22 and 24 simultaneously. Minimal displacement has the maximum rotational drive load and the only input necessary to this design is to compensate for internal leakage from high pressure to low pressure. Therefore, a pressure source with minimal flow capacity could be utilized to achieve the maximum drive capability.

The invention has been described with reference to the preferred embodiment. Obviously, modifications and alterations will occur to others upon a reading and understanding of the specification. It is intended by applicant to include all such modifications and alterations insofar as they come within the scope of the appended claims or the equivalents thereof.

Having thus described the invention, it is now claimed:

1. A variable displacement load device having a center of operation, comprising:

at least two spherical balls having a radius of curvature;

a front cover housing having a port, and channel, said port able to direct inlet pressure to said mechanical face seal, said channel having an involute profile, a depth, a tangent, and a radius of curvature, said channel involute profile having four regions comprised of two regions of involute curves, a radius dwell region, and a blended radius region;

a rotor having slots, two sides, an inner and outer diameter and a center, said slots each having a radius of curvature, ports and an angle, said slot angle being aligned with said tangent of said channel involute profile, said slots mirroring one another on said sides of said rotor, said slots rotate around said channel of said front cover housing, said ports being able to allow a fluid to enter and exit said rotor slots, said slots radius of curvature being minimized as compared to said channel radius of curvature thus allowing said balls to roll within said channel involute profile and limit internal leakage;

a variable seal plug having a hole, said hole providing a path for said fluid to move in and out of said rotor slots, said variable seal plug mounted to said rear cover;

a variable vane shaft having an external drive, said variable vane shaft able to vary its location with respect to said housing channel by said external drive; and, a rear cover housing having a mounting surface, an inlet port, channels, said port able to direct low pressure to said variable seal plug and variable vane shaft, said channels having an involute profile, a depth, a tangent, and a radius of curvature, said channel involute profile having four regions comprised of two regions of involute curves, a radius dwell region, and a blended radius region.

2. The variable displacement load device as recited within claim 1 wherein said channel involute profile is a continuous, differentiable curve having only one tangent and only one point normal at any point on said curve.

3. The variable displacement load device as recited within claim 1 wherein said base circle has a tangent and said tangent is perpendicular to said channel involute curve profile.

4. The variable displacement load device as recited within claim 1 further comprising a bushing mounted within the rotor thereby supporting said variable vane shaft.

5. The variable displacement load device as recited within claim 1 further comprising a ball seal, said ball seal having an inner diameter larger than said ball radius, and said ball seal inner diameter being offset from said ball radius thereby minimizing leakage yet allowing said ball to roll within said channel.

6. The variable displacement load device as recited within claim 1 further comprising a ball seal having an inner and outer diameter, said ball seal attached to said ball thereby able to travel with said ball.

7. The variable displacement load device as recited within claim 1 further comprising a mechanical face seal mounted to said front cover housing.

8. The variable displacement load device as recited within claim 1 wherein said channel involute curve region being two (2) 104 degree regions of involute curves.

9. The variable displacement load device as recited within claim 1 wherein said channel involute profile radius dwell region being an 80 degree region of radius dwell.

10. The variable displacement load device as recited within claim 1 where in said channel involute profile blended radius region being a 72 degree region of a blended radius.

11. The variable displacement load device as recited within claim 1 wherein said channel depth is 10% to 70% of said ball diameter.

12. The variable displacement load device as recited within claim 1 wherein said tangent to said base circle, said base circle being defined as the circle from which the involute curve is developed and said base circle perpendicular to said involute curve.

13. The variable displacement load device as recited within claim 8 wherein said two (2) involute curve regions equate to linear motion of said balls in said rotor slots.

14. The variable displacement load device as recited within claim 13 wherein said two (2) involute curve regions equate to linear motion irrespective of whether the ball travel is increasing or decreasing in said rotor slots.

15. The variable displacement load device as recited within claim 9 wherein said radius dwell region equates to dwell motion of said balls in said rotor slots.

16. The variable displacement load device as recited within claim 10 wherein said blended radius region equates to slight ball motion within the blended radius of said balls in said rotor slots.

17. The variable displacement load device as recited within claim 5 wherein clearances between said ball seal and said rotor slot exist to allow said ball seals to move freely with said ball and minimize internal leakage.

18. The variable displacement load device as recited within claim 1 wherein said variable seal plug further comprises a cross-hole, said cross-hole allowing said fluid to enter or exit said rotor slot.

19. The variable displacement load device as recited within claim 1 wherein said variable seal plug further comprises an alignment means to align said variable seal plug to said rotor.

20. The variable displacement load device as recited within claim 1 wherein said variable vane shaft further comprises a make-before-break connection means.

21. The variable displacement load device as recited within claim 1 wherein said variable seal plug further comprises a make-before-break connection means.

22. The variable displacement load device as recited within claim 1 wherein when said rotor is rotated said balls distance from the center of operation of said device vary.

23. The variable displacement load device as recited within claim 22 wherein when said rotor is rotated said rotor slot is filled with said fluid on a trailing side of said balls and said fluid is discharged on a leading side of said balls, said leading side being the direction of ball travel.

24. The variable displacement load device as recited within claim 1 wherein said channel depth of said front cover housing is 10% to 70% of said ball diameter.

25. The variable displacement load device as recited within claim 1 wherein said channel depth of said rear cover housing is 10% to 70% of said ball diameter.

26. The variable displacement load device as recited within claim 1 wherein said channel of said front cover housing radius of curvature having a larger radius than said ball curvature radius and being offset with respect to said ball curvature.

27. The variable displacement load device as recited within claim 1 wherein said channel of said rear cover housing radius of curvature having a larger radius than said ball curvature radius and being offset with respect to said ball curvature.

28. The variable displacement load device as recited within claim 1 wherein said slots radius of curvature being larger than said ball radius of curvature.

29. The variable displacement load device as recited within claim 1 wherein said ports of said slots having common porting with respect to said rotor inner diameter and said rotor outer diameter.

* * * * *